United States Patent [19]

Kaneko et al.

[11] Patent Number: 4,623,617

[45] Date of Patent: Nov. 18, 1986

[54] SILVER HALIDE COLOR PHOTOGRAPHIC MATERIAL

[75] Inventors: Yutaka Kaneko, Sagamihara; Kenji Kadokura, Hachioji; Toshihiko Kinura, Hino, all of Japan

[73] Assignee: Konishiroku Photo Industry Co., Ltd., Japan

[21] Appl. No.: 785,507

[22] Filed: Oct. 8, 1985

[30] Foreign Application Priority Data

| | | | |
|---|---|---|---|
| Oct. 9, 1984 | [JP] | Japan | 59-213470 |
| Dec. 28, 1984 | [JP] | Japan | 59-280486 |
| Apr. 18, 1985 | [JP] | Japan | 60-85195 |

[51] Int. Cl.[4] ..... G03C 7/32; G03C 7/26

[52] U.S. Cl. ..... 430/551; 430/558

[58] Field of Search ..... 430/551, 558

[56] References Cited

U.S. PATENT DOCUMENTS

| | | | |
|---|---|---|---|
| 3,928,044 | 12/1975 | Arai et al. | 430/551 |
| 4,268,621 | 5/1981 | Ogi et al. | 430/551 |
| 4,562,146 | 12/1985 | Masuda et al. | 430/558 |

*Primary Examiner*—Mary F. Downey

*Attorney, Agent, or Firm*—Finnegan, Henderson, Farabow, Garrett & Dunner

[57] ABSTRACT

A silver halide color photographic material is disclosed, said material containing a magenta color image-forming coupler represented by the following formula (I) and a compound represented by the following formuls (XI):

(I)

wherein

Z represents the group of nonmetallic atoms necessary for forming a nitrogen-containing heterocyclic ring, provided that the ring to be formed by said Z may have a substituent;

X represents a hydrogen atom or a substituent capable of leaving upon reaction with the oxidized product of a color developing agent; and R represents a hydrogen atom or a substituent.

(XI)

wherein $R^1$ and $R^4$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamido group, a cycloalkyl group or an alkoxycarbonyl group;

$R^2$ represents a hydrogen atom, an alkyl group, an alkenyl group, an aryl group, an acyl group, a cycloalkyl group or a heterocyclic group;

$R^3$ represents a hydrogen atom, a halogen atom, an alkyl group, an alkenyl group, an aryl group, an aryloxy group, an acyl group, an acylamino group, an acyloxy group, a sulfonamide group, a cycloalkyl group or an alkoxycarbonyl group;

$R^2$ and $R^3$ may cooperate to form a 5- or 6-membered ring; and

Y represents the group of atoms necessary to form a chroman or cumaran ring.

10 Claims, No Drawings

SILVER HALIDE COLOR PHOTOGRAPHIC MATERIAL

FIELD OF THE INVENTION

The present invention relates to a silver halide color photographic material, and more particularly, to a silver halide color photographic material that forms a dye image which is stable against heat or light and in which no stain is likely to occur.

BACKGROUND OF THE INVENTION

As is well known, in color development following the image-wise exposure of a silver halide color photographic material, the oxidized product of an aromatic primary amine color developing agent enters into coupling reaction with a color former to form a color image composed of, for example, indophenol, indoaniline, indamine, azomethine, phenoxazine, phenazine or other dyes similar thereto. In this photographic process, color reproduction is usually achieved by the substractive process using a silver halide color photographic material wherein blue-, green- and red-sensitive silver halide emulsion layers contain color formers, or couplers that will develop colors which are the respective complements of blue, green and red, namely, yellow, magenta and cyan colors.

An illustrative coupler used to form a yellow color image is acylacetanilide compound. Exemplary magenta image forming couplers include pyrazolone, pyrazolobenzimidazole, pyrazolotriazole and indazolone compounds. Among the couplers commonly used for cyan image formation are included phenolic and naphtholic compounds.

The dye images formed by the coupling reaction with such color formers and the oxidation product of aromatic primary amine color developing agent are required to undergo no discoloration or fading even if they are exposed to light or stored under hot and humid atmosphere for a prolonged period. It is also required that the background of a silver halide color photographic material (to be hereunder referred to simply as a color photographic material) or the areas where no color has formed should not undergo any yellow staining (hereunder Y staining) as a result of exposure to light or moist heat.

Magenta couplers are much more sensitive than yellow and cyan couplers to Y staining in the background caused by heat or moist heat as well as to the fading of the image areas resulting from prolonged exposure to light, and this has often caused serious problems in conventional color photography.

Couplers extensively used for magenta dye formation are 1,2-pyrazolo-5-ones. Dyes produced from such compounds generally have primary absorption at about 550 nm but they also have secondary absorption at about 430 nm. In order to minimize such secondary absorption, various efforts have been made. For example, magenta couplers having an anilino group at 3-position of 1,2-pyrazolo-5-ones have relatively small degree of secondary absorption and are particularly useful for obtaining color images in print format. Details of this technique are found in U.S. Pat. No. 2,343,703 and British Pat. No. 1,059,994. However, such substituted magenta couplers are very poor in image keeping quality, especially in the fastness of color image to light. In addition, the background is highly sensitive to Y staining.

Other magenta couplers that have been proposed as means capable of reducing the secondary absorption at about 430 nm include pyrazolobenzimidazoles (British Pat. No. 1,047,612), indazolones (U.S. Pat. No. 3,770,447), 1H-pyrazolo[5,1-c]-1,2,4-triazole type couplers (U.S. Pat. No. 3,725,067 and British Pat. Nos. 1,252,418 and 1,334,515), 1H-pyrazolo[1,5-b]-1,2,4-triazole type couplers (Research Disclosure No. 24,531) 1H-pyrazolo[1,5-c]-1,2,3-triazole type couplers (Research Disclosure No. 24,626), 1H-imidazolo[1,2-b]-pyrazole type couplers (Unexamined Published Japanese Patent Application No. 162548/1984 and Research Disclosure No. 24531), 1H-pyrazolo[1,5-b]-pyrazole type couplers (Research Disclosure No. 24230) and 1H-pyrazolo[1,5-d]-tetrazole type couplers (Research Disclosure No. 24220). Dyes formed from the 1H-pyrazolo-[5,1-c]-1,2,4-triazole type couplers, 1H-pyrazolo[1,5-b]-1,2,4-triazole type couplers, 1H-pyrazolo[1,5-c]-1,2,3-triazole type couplers, 1H-imidazolo[1,2-b]-pyrazole type couplers, 1H-pyrazolo[1,5-d]-pyrazole type couplers and 1H-pyrazolo[1,5-d]tetrazole type couplers are preferred in terms of color reproduction over dyes formed from the 1,2-pyrazolo-5-ones having an anilino group at 3-position because the former has a far smaller secondary absorption at about 430 nm. Furthermore, the background of photographic materials using these couplers as magenta couplers has extremely low sensitivity to Y staining resulting from exposure to light, heat or moisture.

However, the azomethine dye formed from these couplers has a very small degree of fastness to light. In addition, such dye is highly likely to discolor upon exposure to light and has yet to be used commercially in color photographic materials, especially in color prints which are subject to considerable degradation resulting from the discoloration of dyes.

Unexamined Published Japanese Patent Application No. 125732/1984 proposes a technique for improving the light fastness of the magenta dye image from the 1H-pyrazolo[5,1-c]-1,2,4-triazole type magenta coupler by using it in combination with a phenolic compound or a phenyl ether compound. However, even this technique is not completely satisfactory in preventing the magenta dye image from fading upon exposure to light, and is practically incapable of preventing the light discoloration of such dye image.

SUMMARY OF THE INVENTION

One object, therefore, of the present invention is to provide a color photographic material that is capable of faithful color reproduction and which exhibits a highly improved light fastness in magenta dye image.

Another object of the invention is to provide a color photographic material producing a magenta dye image that experiences a minimal degree of discoloration upon exposure to light.

A further object of the invention is to provide a color photographic material that is protected against the occurrence of Y stain in the background resulting from exposure to light or moist heat.

These objects of the invention can be achieved by a silver halide color photographic material containing a magenta color image-forming coupler represented by the following formula (I) and a compound represented by the following formula (XI):

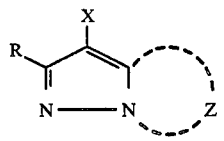

(I)

wherein

Z represents the group of nonmetallic atoms necessary for forming a nitrogen-containing heterocyclic ring, provided that the ring to be formed by said Z may have a substituent;

X represents a hydrogen atom or a substituent capable of leaving upon reaction with the oxidized product of a color developing agent; and R represents a hydrogen atom or a substituent.

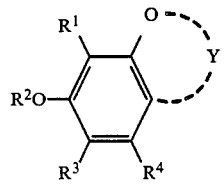

(XI)

wherein $R^1$ and $R^4$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamido group, a cycloalkyl group or an alkoxycarbonyl group;

$R^2$ represents a hydrogen atom, an alkyl group, an alkenyl group, an aryl group, an acyl group, a cycloalkyl group or a heterocyclic group;

$R^3$ represents a hydrogen atom, a halogen atom, an alkyl group, an alkenyl group, an aryl group, an aryloxy group, an acyl group, an acylamino group, an acyloxy group, a sulfonamide group, a cycloalkyl group or an alkoxycarbonyl group;

$R^2$ and $R^3$ may cooperate to form a 5- or 6-membered ring; and

Y represents the group of atoms necessary to form a chroman or cumaran ring.

Hereinafter, unless otherwise specifically indicated, the compounds represented by formula (XI) of the present invention are referred to as magenta dye image stabilizers.

In the magenta coupler of formula (I), the substituent represented by R includes, for example, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro-compound residue, a bridged hydrocarbon compound residue, an alkoxy group, an aryloxy group, a heterocyclicoxy group, a siloxy group, an acyloxy group, a carbamoyloxy group, an amino group, an acylamio group, a sulfonamide group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclicthio group.

The halogen atom includes, for example, chlorine and bromine atoms, the chlorine atom being particularly preferable.

The alkyl group represented by R is preferably one having 1 to 32 carbon atoms, the alkenyl group and the alkinyl group are preferably those having 2 to 32 carbon atoms, and the cycloalkyl group and the cycloalkenyl group are preferably those having 3 to 12, particularly 5 to 7, carbon atoms, the alkyl, alkenyl and alkinyl groups each including those having a straight or branched chain.

These alkyl, alkenyl, alkinyl, cycloalkyl and cycloalkenyl groups each may have one or more substituents. Such substituents include, in addition to an aryl group, a cyano group, a halogen atom, a heterocyclic group, a cycloalkyl group, a cycloalkenyl group, a spiro-compound residue and a bridged hydrocarbon compound residue, for example, those substituted through the carbonyl group, such as acyl, carboxy, carbamoyl, alkoxycarbonyl and aryloxycarbonyl groups, and those substituted through the hetero atom, for example, those substituted through the oxygen atom, such as hydroxy, alkoxy, aryloxy, heterocyclicoxy, siloxy, acyloxy and carbamoyloxy groups, those substituted through the nitrogen atom, such as nitro, amino (including dialkylamino and the like), sulfamonylamino, alkoxycarbonylamino, aryloxycarbonylamino, acylamino, sulfoneamido, imido and ureido groups, those substituted through the sulfur atom, such as alkylthio, arylthio, heterocyclicthio, sulfonyl, sulfinyl and sulfamoyl groups, and those substituted through the phosphorus atom, such as a phosphonyl group and the like.

Examples of the alkyl group represented by R include, for example, methyl, ethyl, isopropyl, t-butyl, pentadecyl, heptadecyl, 1-hexylnonyl, 1,1'-dipentylnonyl, 2-chloro-t-butyl, trifluoromethyl, 1-ethoxytridecyl, 1-methoxyisopropyl, methanesulfonylethyl, 2,4-di-t-amylphenoxymethyl, anilino, 1-phenylisopropyl, 3-m-butanesulfonaminophenoxypropyl, 3-4'-{α-[4''(p-hydroxybenzenesulfonyl)phenoxy]dodecanoylamino}phenylpropyl, 3-{4'-[α-(2'',4''-di-t-amylphenoxy)-butaneamido]phenyl}propyl, 4-[α-(O-chlorophenoxy)-tetradecanamidophenoxy]propyl, allyl, cyclopentyl and cyclohexyl groups.

The aryl group represented by R is preferably a phenyl gruop, and may have a substituent such as an alkyl, alkoxy or acylamino group.

Examples of the aryl group include phenyl, 4-t-butylphenyl, 2,4-di-t-amylphenyl, 4-tetradecaneamidophenyl, hexadecyl-oxyphenyl and 4'-[α-(4''-t-butylphenoxy)tetoradecaneamido]phenyl groups.

The heterocyclic group represented by R is preferably a 5- to 7-membered heterocyclic ring, and may be substituted or may be condensed. Examples of the heterocyclic group include 2-furyl, 2-thienyl, 2-pyrimidinyl and 2-benzothiazonyl groups.

The acyl group represented by R includes, for example, alkylcarbonyl group such as acetyl, phenylacetyl, dodecanoyl and α-2,4-di-t-amylfenoxybutanoyl groups, and an arylcarbonyl group such as benzoyl, 3-pentadecycloxybenzoyl and p-chlorobenzoyl groups.

The sulfonyl group represented by R includes, for example, an alkylsulfonyl group such as methylsulfonyl and dodecylsulfonyl groups, and an arylsulfonyl group such as benzenesulfonyl and p-toluenesulfonyl groups.

The sulfinyl group represented by R includes, for example, an alkylsulfinyl group such as ethylsulfinyl, octylsulfinyl and 3-fenoxybutylsulfinyl groups and an arylsulfinyl group such as phenylsulfinyl and m-pentadecylphenylsulfinyl groups.

The phosphonyl group represented by R includes, for example, an alkylphosphonyl group such as butyloxyoctyl phosphonyl group, an alkoxyphosphonyl group such as octyloxyphosphonyl group, an aryloxyphosphonyl group such as phenoxyphosphonyl group and an arylphosphonyl group such as phenylphosphonyl group.

The carbamoyl group represented by R includes, for example, those substituted with an alkyl or aryl (preferably phenyl) group, such as, N-methylcarbamoyl, N,N-dibutylcarbamoyl, N-(2-pentadecyloctylethyl)carbamoyl, N-ethyl-N-dodecylcarbamoyl and N-{3-(2,4-di-t-amylphenoxy)propyl}carbamoyl group.

The sulfamoyl group represented by R includes, for example, those substituted with an alkyl or aryl (preferably phenyl) group, such as N-propylsulfamoyl, N,N-diethylsulfamoyl, N-(2-pentadecyloxyethyl)sulfamoyl, N-ethyl-N-dodecylsulfamoyl and N-phenylsulfamoyl groups.

The spiro-compound residue represented by R includes, for example, spiro[3,3]heptan-1-yl and the like.

The bridged hydrocarbon compound residue represented by R includes, for example, bicyclo[2,2,1]heptane-1-yl, tricyclo[3,3,1,1$^{3,7}$]decane-1-yl and 7,7-dimethyl-bicyclo[2,2,1]heptane-1-yl.

The alkoxy group reprented by R includes, for example, those substituted further with such a substituent(s) as is shown above with the alkyl group, such as methoxy, propoxy, 2-ethoxyethoxy, pentadecyloxy, 2-dodecyloxyethoxy and phenethyloxyethoxy.

The aryloxy group represented by R is preferably a phenyloxy group, and includes, for example, those of which aryl nucleus is further subsituted with such a substituent(s) or an atom(s) as is shown above with the aryl group, such as phenoxy, p-t-butylphenoxy and m-pentadecylphenoxy groups.

The heterocyclicoxy group represented by R is preferably one having a 5- to 7-membered heterocyclic ring, and includes those of which heterocyclic ring has a substituent, such as 3,4,5,6-tetrahydropyranyl-2-oxy and 1-phenyltetrazole-5-oxy groups.

The siloxy group represented by R includes those substituted with an alkyl group, for example, trimethylsiloxy, triethylsiloxy and dimethylbutylsiloxy groups.

The acyloxy group represented by R includes, for example, alkylcarbonyloxy and arylcarbonyloxy groups, and further includes those having a substituent(s) such as acetyloxy, α-chloroacetyloxy and benzoyloxy groups.

The carbamoyloxy group represented by R includes those substituted with an alkyl or aryl group, such as N-ethylcarbamoyloxy, N,N-diethylcarbamoyloxy and N-phenylcarbamoyloxy groups.

The amino group represented by R includes those substituted with an alkyl or aryl (preferably phenyl) group, such as ethylamino, anilino, m-chloroanilino, 3-pentadecyloxycarbonylanilino and 2-chloro-5-hexadecaneamidoanilino groups.

The acylamino group represented by R includes alkylcarbonylamino and arylcarbonylamino (preferably phenylcarbonylamino) groups, and further includes those having a substituent(s) such as acetamido, α-ethylpropaneamido, N-pnenylacetamido, dodecaneamido, 2,4-di-t-amylphenoxyacetamido and α-3-t-butyl-4-hydroxyphenoxybutaneamido groups.

The sulfonamido groups represented by R includes alkylsulfonylamino and arylsulfonylamino groups, and further includes those having a substituent(s), such as methylsulfonylamino, pentadecylsulfonylamino, benzensulfonamido, p-toluenesulfonamido and 2-methoxy-5-t-amylbenzenesulfonamido groups.

The imido group represented by R includes those which are open-chained or close-chained, and further includes those having a substituent(s), such as, succinimido, 3-heptadecylsuccinimido, phthalimido and glutarimido groups.

The ureido group represented by R includes those substituted with an alkyl or aryl (preferably phenyl) group, such as N-ethylureido, N-methyl-N-decylureido, N-phenylureido and N-p-tolylureido groups.

The sulfamoylamino group represented by R includes those substituted with an alkyl or aryl (preferably phenyl) group, such as N,N-dibutylsulfamoylamino, N-methylsulfamoylamino and N-phenylsulfamoylamino groups.

The alkoxycarbonylamino group represented by R includes those having a substituent(s), such as methoxycarbonylamino, methoxyethoxycarbonylamino and octadecyloxycarbonylamino groups.

The aryloxycarbonylamino group represented by R includes those having a substituent(s), such as phenoxycarbonylamino and 4-methylphenoxycarbonylamino groups.

The alkoxycarbonyl group represented by R includes those having a substituent(s), such as methoxycarbonyl, butyloxycarbonyl, dodecyloxycarbonyl, octadecyloxycarbonyl, ethoxymethoxycarbonyloxy and benzyloxycarbonyl groups.

The aryloxycarbonyl group represented by R includes those having a substituent(s), such as phenoxycarbonyl, p-chlorophenoxycarbonyl and m-pentadecyloxyphenoxycarbonyl groups.

The alkylthio group represented by R includes those having a substituent(s), such as ethylthio, dodecylthio, octadodecylthio, phenethylthio and 3-phenoxypropylthio groups.

The arylthio group represented by R is preferably a phenylthio group, and includes those having a substituent(s), such as phenylthio, p-methoxyphenylthio, 2-t-octylphenylthio, 3-octadecylphenylthio, 2-carboxyphenylthio and p-acetaminophenylthio groups.

The heterocyclicthio group, represented by R is preferably a 5- to 7-membered heterocyclicthio group, and includes those having a condensed ring or having a substituent(s). Examples of such heterocyclicthio group include 2-pyridylthio, 2-benzothiazolylthio and 2,4-diphenoxy-1,3,5-triazol-6-thio groups.

The substituent represented by X that is capable of leaving upon reaction with the oxidized product of a color developing agent includes, for example, those substituted through the carbon, oxygen, sulfur or nitrogen atom other than the halogen atom (chlorine, bromine or fluorine atom).

The groups which are substituted through the carbon atom include, in addition to the carboxyl group, a group represented by the following formula:

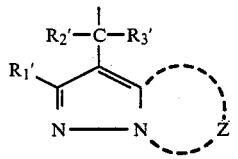

(wherein $R_1'$ is the same in meaning as said R; Z' is the same in meaning as said Z; and $R_2'$ and $R_3'$ each represents a hydrogen atom, an aryl, alkyl or heterocyclic group), a hydroxymethyl group and a triphenylmethyl group.

The groups which are substituted through the oxygen atom include, for example, alkoxy, aryloxy, heterocyclicoxy, acyloxy, sulfonyloxy, alkoxycarbonyloxy, aryloxycarbonyloxy, alkyloxalyloxy and alkoxyoxalyloxy groups.

The alkoxy group includes those having a substituent(s), such as ethoxy, 2-phenoxyethoxy, 2-cyanoethoxy, phenethyloxy, and p-chlorobenzyloxy groups.

The aryloxy group is preferably a phenoxy group, and includes those having a substituent(s). Examples of such aryloxy group include phenoxy, 3-methylphenoxy, 3-dodecylphenoxy, 4-methanesulfoneamidophenoxy, 4-[α-(3'-pentadecylphenoxy)butaneamido]phenoxy, hexadecylcarbamoylmethoxy, 4-cyanophenoxy, 4-methanesulfonylphenoxy, 1-naphthyloxy and p-methoxyphenoxy groups.

The heterocyclicoxy group is preferably a 5- to 7-membered heterocyclicoxy group, and may be a condensed ring or include those having a substituent(s). Examples of such heterocyclicoxy group include 1-phenyltetrazolyloxy and 2-benzothiazolyloxy groups.

The acyloxy group includes, for example, an alkylcarbonyloxy group such as acetoxy and butanoyloxy groups, an alkenylcarbonyloxy group such as a cinnamoyloxy group, and an arylcarbonyloxy group such as a benzoyloxy group.

The sulfonyloxy group includes, for example, butanesulfonyloxy and methanesulfonoyloxy groups.

The alkoxycarbonyloxy group includes, for example, ethoxycarbonyloxy and benzyloxycarbonyloxy groups.

The aryloxycarbonyloxy group includes a phenoxycarbonyloxy group and the like.

The alkyloxalyloxy group includes, for example, a methyloxalyloxy group.

The alkoxyoxalyloxy group includes an ethoxyoxalyloxy group and the like.

The group which is substituted through the sulfur atom includes, for example, alkylthio, arythio, heterocyclicthio and alkyloxythiocarbonylthio groups.

The alkylthio group includes butylthio, 2-cyanoethylthio, phenetylthio and benzylthio groups.

The arylthio group includes phenylthio, 4-methanesulfoneamidophenylthio, 4-dodecylphenetylthio, 4-nonafluoropentaneamidophenetylthio, 4-carboxyphenylthio and 2-ethoxy-5-t-butylphenylthio groups.

The heterocyclicthio group includes, for example, 1-phenyl-1,2,3,4-tetrazolyl-5-thio and 2-benzothiazolylthio groups.

The alkyloxythiocarbonylthio group includes a dodecyloxythiocarbonylthio group and the like.

The group which is substituted through the nitrogen atom includes, for example, one represented by the formula

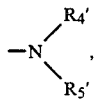

wherein $R_4'$ and $R_5'$ each represents a hydrogen atom, an alkyl, aryl, heterocyclic, sulfamoyl, carbamoyl, acyl, sulfonyl, aryloxycarbonyl or alkoxycarbonyl group, and $R_4'$ and $R_5'$ may cooperate to form a heterocyclic ring, provided that $R_4'$ and $R_5'$ are not hydrogen atoms at the same time.

The alkyl group may be straight-chained or branched and is preferably one having 1 to 22 carbon atoms. Also, the alkyl group may include those having a substituent(s). Examples of such substituent include, for example, aryl, alkoxy, aryloxy, alkylthio, arylthio, alkylamino, arylamino, acylamino, sulfoneamido, imino, acyl, alkylsulfonyl, arylsulfonyl, carbamoyl, sulfamoyl, alkoxycarbonyl, aryloxycarbonyl, alkyloxycarbonylamino, aryloxycarbonylamino, hydroxy, carboxyl and ciano groups and halogen atom. Examples of such alkyl group includes, for example, ethyl, octyl, 2-ethylhexyl and 2-chloroethyl group.

The aryl group represented by $R_4'$ or $R_5'$ is preferably one having 6 to 32 carbon atoms, particularly a phenyl or naphtyl group, and may include those having a substituent(s). Such substituent includes a substituent for the alkyl group represented by $R_4'$ or $R_5'$ and an alkyl group. Examples of the aryl group include, for example, phenyl, 1-naphtyl and 4-methylsulfonylphenyl groups.

The heterocyclic group represented by $R_4'$ or $R_5'$ is preferably a 5- or 6-membered ring, and may be a condensed ring or include those having a substituent(s). Examples of such heterocyclic group include 2-furyl, 2-quinolyl, 2-pyrimidyl, 2-benzothiazolyl and 2-pyridyl groups.

The sulfamoyl group represented by $R_4'$ or $R_5'$ includes N-alkylsulfamoyl, N,N-dialkylsulfamoyl, N-arylsulfamoyl and N,N-diarylsulfamoyl groups, and these alkyl and aryl groups may have such a substituent(s) as is mentioned with respect to the alkyl and aryl groups. Examples of such sulfamoyl group includes, for example, N,N-diethylsulfamoyl, N-methylsulfamoyl, N-dodecylsulfamoyl and N-p-tolylsulfamoyl groups.

The carbamoyl group represented by $R_4'$ or $R_5'$ includes N-alkylcarbamoyl, N,N-dialkylcarbamoyl, N-arylcarbamoyl and N,N-diarylcarbamoyl groups, and these alkyl and aryl groups may have such a substituent(s) as is mentioned with respect to the alkyl and aryl groups. Examples of such carbamoyl group include, for example, N,N-diethylcarbamoyl, N-methylcarbamoyl, N-dodecylcarbamoyl, N-p-cianophenylcarbamoyl and N-p-tolylcarbamoyl groups.

The acyl group represented by $R_4'$ or $R_5'$ includes, for example, alkylcarbonyl, arylcarbonyl and heterocyclicarbonyl groups, and the alkyl, aryl and heterocyclic groups may have a substituent(s). Examples of such acyl group include, for example, hexafluorobutanoyl, 2,3,4,5,6-pentafluorobenzoyl, acetyl, benzoyl, naphtoyl and 2-furylcarbonyl groups.

The sulfonyl group represented by $R_4'$ or $R_5'$ includes alkylsulfonyl, arylsulfonyl and heterocyclicsulfonyl groups, and may have a substituent(s). Examples of such sulfonyl group include, for example, ethanesulfonyl, benzenesulfonyl, octanesulfonyl, naphthalenesulfonyl and p-chlorobenzenesulfonyl groups.

The aryloxycarbonyl group represented by $R_4'$ or $R_5'$ may have such a substituent(s) as is mentioned with respect to the aryl group, and includes a phenoxycarbonyl group and the like.

The alkoxycarbonyl group represented by $R_4'$ or $R_5'$ may have such a substituent(s) as is mentioned with respect to alkyl group, and includes methoxycarbonyl, dodecyloxycarbonyl and benzyloxycarbonyl groups.

The heterocyclic ring which is formed through cooperation of $R_4'$ and $R_5'$ is preferably a 5- or 6-membered ring, may be saturated or unsaturated, may or may not be an aromatic ring, or may be a condensed ring. Examples of such heterocyclic ring include, for example, N-phthalimido, N-succinimide, 4-N-urazolyl, 1-N-hydantoinyl, 3-N-2,4-dioxooxazolidinyl, 2-N-1,1-dioxo-3-(2H)-oxo-1,2-benzthiazolyl, 1-pyrrolyl, 1-pyrrolidinyl, 1-pyrazolyl, 1-pyrazolidinyl, 1-piperidinyl, 1-pyrrolinyl, 1-imidazolyl, 1-imidazolinyl, 1-indolyl, 1-isoindolinyl, 2-iso-indolyl, 2-isoindolinyl, 1-benzotriazolyl, 1-benzoimidazolyl, 1-(1,2,4-triazolyl), 1-(1,2,3-triazolyl), 1-(1,2,3,4-tetrazolyl), N-morpholinyl, 1,2,3,4-tetrahydroquinolyl, 2-oxo-1-pyrrolidinyl, 2-1H-pyridone, phthalazione and 2-oxo-1-piperidinyl groups. These heterocyclic groups may be substituted by alkyl, aryl, alkyloxy, aryloxy, acyl, sulfonyl, alkylamino, arylamino, acylamino, sulfoneamino, carbamoyl, sulfamoyl, alkylthio, arylthio, ureido, alkoxycarbonyl, aryloxycarbonyl, imido, nitro, cyano, carboxyl groups as well as by a halogen atom and the like.

The nitrogen-containing heterocyclic ring which is formed by Z or Z' includes pyrazol, imidazol, triazol and tetrazol rings, and may have such a substituent(s) as is mentioned with respect to R.

When the substituent(s) (for example, either of R and $R_1$ to $R_8$) on the heterocyclic ring in formula (I) and in formulas (II) to (VIII) to be mentioned later has the following formula:

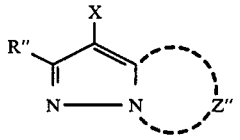

(wherein R'', X and Z'' are the same in meaning as R, X and Z in formula (I), respectively), the coupler formed is the so-called bis-type coupler, which is included in the present invention. The ring which is formed by Z, Z', Z'' as well as by $Z_1$ to be stated later may be condensed with another ring (for example 5- to 7-membered cycloalkene). For example, in formula (V), $R_5$ and $R_6$, and in formula (VI), $R_7$ and $R_8$, may cooperate to form a ring (for example, 5- to 7-membered cycloalkene, or benzene), respectively.

The coupler represented by formula (I) preferably includes, for example, those represented by the following formulas (II) to (VII):

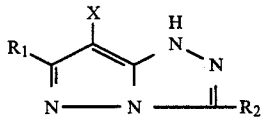

(II)

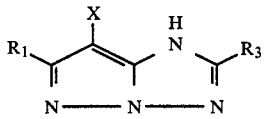

(III)

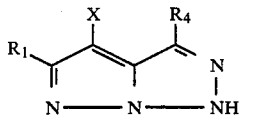

(IV)

-continued

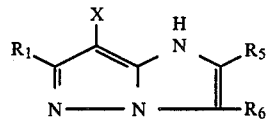

(V)

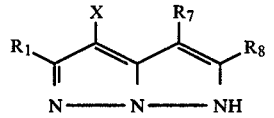

(VI)

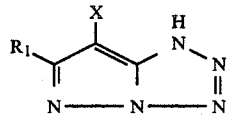

(VII)

wherein $R_1$ to $R_8$ and X are the same in meaning as R and X mentioned above.

The coupler of formula (I) is preferably one represented by the following formula (VIII):

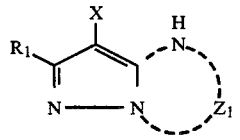

(VIII)

wherein $R_1$, X and $Z_1$ are the same in meaning as R, X and Z in formula (I).

Of the magenta couplers represented by formulas (II) to (VII), those represented by formula (II) are particularly preferable.

With respect to the substituent(s) on the heterocyclic ring in formalas (I) to (VIII), R in formula (I) and $R_1$ in formulas (II) to (VIII) are preferable when they satisfy the following requirement 1, the same R and $R_1$ are more preferable when they satisfy the following requirements 1 and 2, and the same R and $R_1$ are most preferable when they satisfy all of the following requirements 1, 2 and 3:

Requirement 1: The root atom bonded directly to the heterocyclic ring is a carbon atom.

Requirement 2: Said carbon atom has only one hydrogen atom or has no hydrogen atom at all, bonded thereto.

Requirement 3: The bonds between said carbon atom and adjacent atoms are all single bonds.

The most preferable substituents R and $R_1$ on the heterocyclic ring are those represented by the following formula (IX):

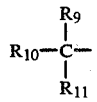

(IX)

wherein $R_9$, $R_{10}$ and $R_{11}$ each represents a hydrogen atom, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, carbamoyl group, a sulfamoyl gruop, a cyano group, a spiro-compound residue, a bridged hydrocarbon compound residue, an alkoxy group, an aryloxy group, a heterocyclicoxy group, a siloxy group, an acyloxy group, a carbamoyloxy group, an amino group, an acylamino group, a sulfonamide group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group, provided that at least two of $R_9$, $R_{10}$ and $R_{11}$ are not hydrogen atoms.

Two of $R_9$, $R_{10}$ and $R_{11}$, for example, $R_9$ and $R_{10}$ may cooperate to form a saturated or unsaturated ring (e.g. cycloalkane, cycloalkane or heterocyclic ring), and further $R_{11}$ may cooperate with said ring to form a bridged hydrocarbon compound residue.

The group represented by $R_9$ to $R_{11}$ may have a substituent(s). Examples of said group and said substituent(s) are the same as the examples of the group represented by R in formula (I) and the substituent(s) mentioned with respect thereto.

Examples of the ring formed by the cooperation of, for example, $R_9$ and $R_{10}$, as well as of the bridged hydrocarbon compound residue which is formed by $R_9$ to $R_{11}$ and the substituent(s) which said residue may have, are the same as the examples of the cycloalkyl, cycloalkenyl, and heterocyclic groups represented by R in formula (I), and the substituent(s) mentioned with respect thereto.

The preferable substituents in formula (IX) are as follows:

(i) Two of $R_9$ to $R_{11}$ are alkyl groups.

(ii) One of $R_9$ to $R_{11}$, for example, $R_{11}$ is a hydrogen atom, and the other two, $R_9$ and $R_{10}$, cooperate with the root carbon atom to form a cycloalkyl group.

Further, the preferable substituent(s) in (i) above is such that two of $R_9$ to $R_{11}$ are alkyl group, and the other one is a hydrogen atom or an alkyl group.

The alkyl and cycloalkyl groups each may have a substituent(s). Examples of such alkyl and cycloalkyl groups as well as of their substituents are the same as the examples of the alkyl and cycloalkyl groups represented by R in formula (I) and the substituents mentioned with respect thereto.

In the present invention, the couplers represented by formula (I) are preferably those having a group represented by the following formula (A):

$$-R^a-SO_2-R^b$$

wherein $R^a$ represents an alkylene group having 3 or more carbon atoms in the straight chain that is bonded to the hydrocarbon at 3-position of the coupler; and $R^b$ represents an alkyl group, a cycloalkyl group or an aryl group.

The alkylene group represented by $R^a$ has 3 or more, preferably 3 to 6, carbon atoms in the straight chain, and include those having a substituent.

Examples of the substituent include, in addition to an aryl group, a cyano group, a halogen atom, a heterocyclic group, a cycloalkyl group, a cycloalkenyl group, a spiro-compound residue and a bridged hydrocarbon compound residue, for example, those substituted through the carbonyl group, such as acyl, carboxy, carbamoyl, alkoxycarbonyl and aryloxycarbonyl groups, and those substituted through the heterto atom, for example, those substituted through the oxygen atom, such as hydroxy, alkoxy, aryloxy, heterocyclicoxy, siloxy, acyloxy and carbamoyloxy groups, those substituted through the nitrogen atom, such as nitro, amino (including dialkylamino and the like), sulfamonylamino, alkoxycarbonylamino, aryloxycarbonylamino, acylamino, sulfoneamido, imido and ureido groups, those substituted through the sulfur atom, such as alkylthio, arylthio, heterocyclicthio, sulfonyl, sulfinyl and sulfamoyl groups, and those substituted through the phosphorus atom, such as a phosphonyl group and the like.

The substituent is preferably a phenyl group.

Preferred examples of the alkylene group represented by $R^a$ are listed below:

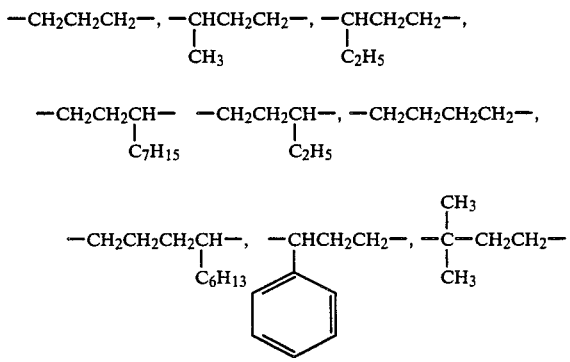

The alkyl group represented $R^b$ may be one having a straight-chain or a branched-chain. Example of such alkyl group includes methyl, ethyl, propyl, iso-propyl, butyl, 2-ethylhexyl, octyl, dodecyl, tetradecyl, hexadecyl, octadecyl and 2-hexyldecyl groups.

The cycloalkyl group represented by $R^b$ is preferably one having a 5- or 6-membered ring, for example, a cyclohexyl group.

The alkyl and cycloalkyl groups represented by $R^b$ include those having a substituent, for example, those exemplified as substituents for $R^a$.

Examples of the aryl group represented by $R^b$ include phenyl and naphthyl groups, and also include those having a substituent. Examples of such substituent include, for example, alkyl groups having a straight chain or a branched chain and those exemplified as substituent for $R^a$. When 2 or more substituents are present, they may be the same or different.

More preferred couplers represented by formula (I) of the present invention are those represented by the following formula (B):

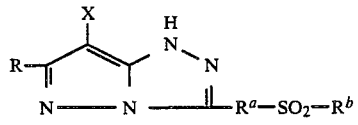

wherein $R^a$ and $R^b$ are the same in meaning as $R^a$ and $R^b$ in formula (A), and R and X are the same in meaning as R and X in formula (I), respectively.

Typical, but by no means limiting, examples of the coupler that can be used in the present invention are listed below.

1
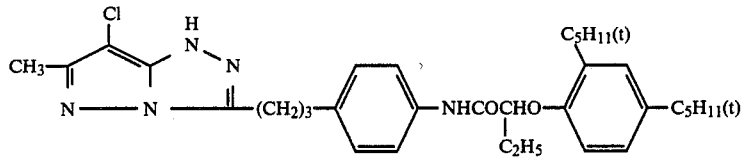
2
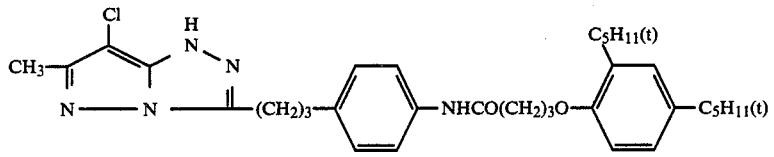
3
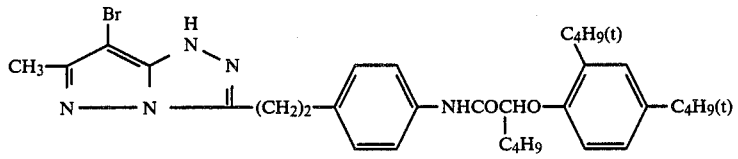
4
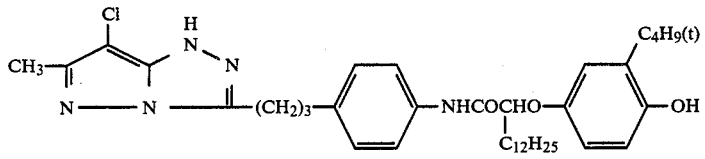
5
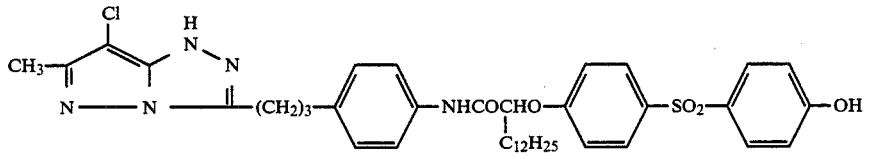
6
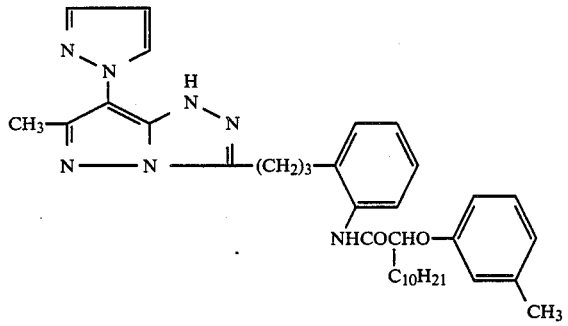
7
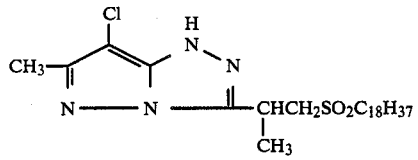
8
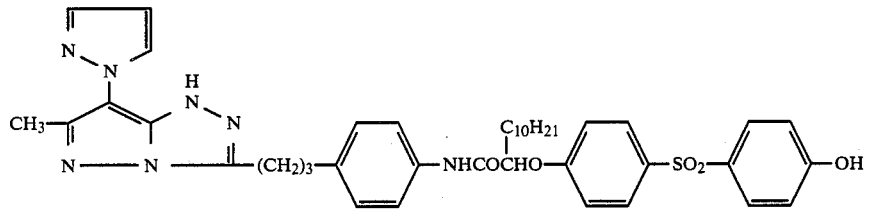

-continued
9
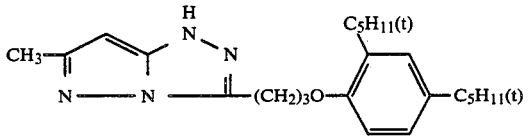
10
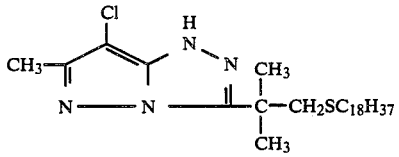
11
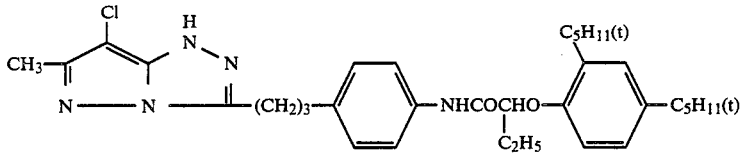
12
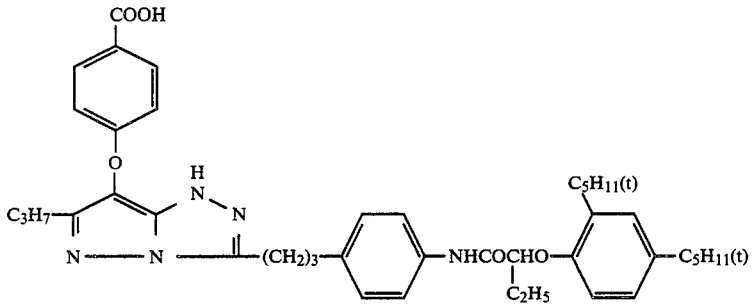
13
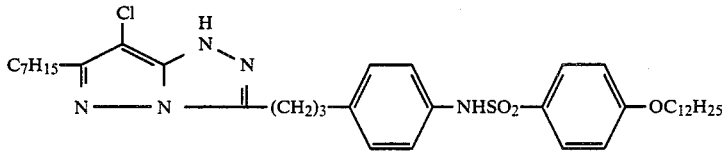
14
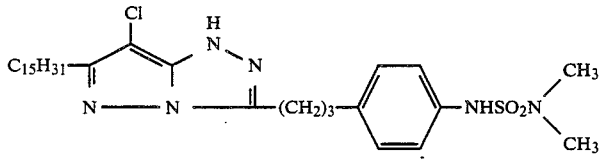
15
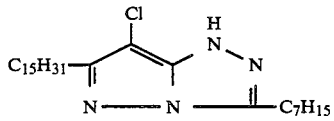
16
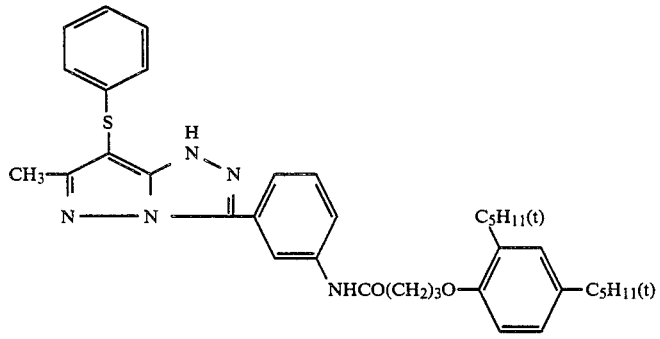

-continued
17
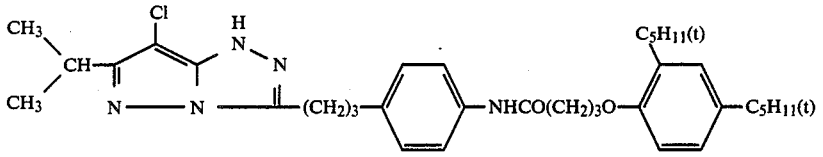
18
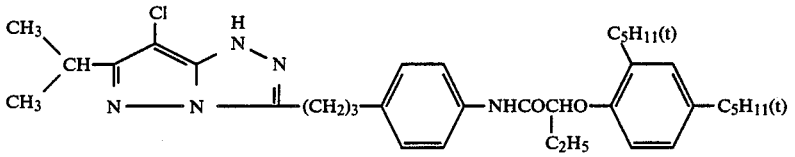
19
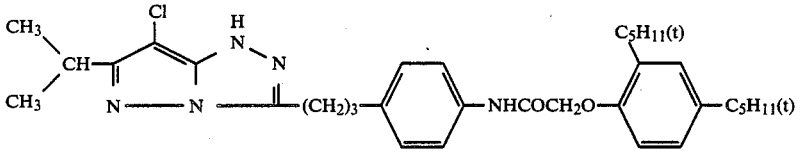
20
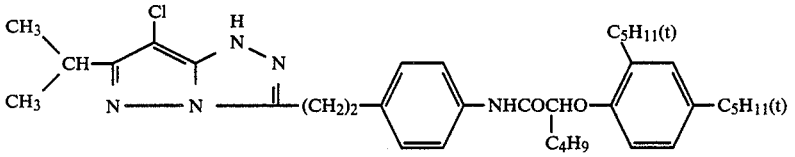
21
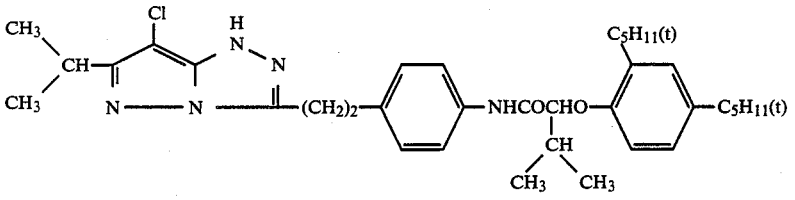
22
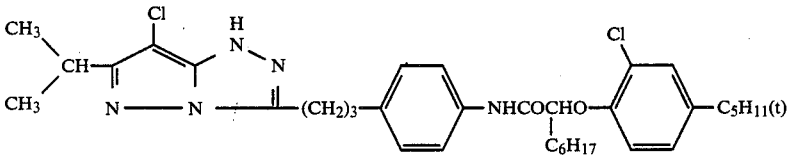
23
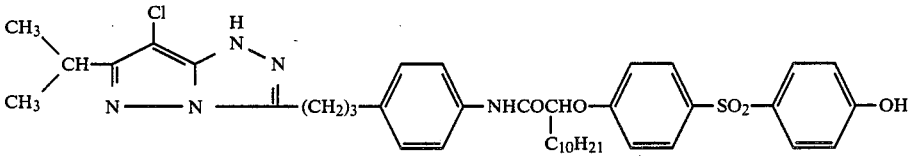
24
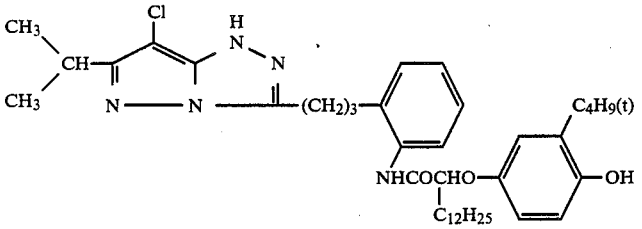
25
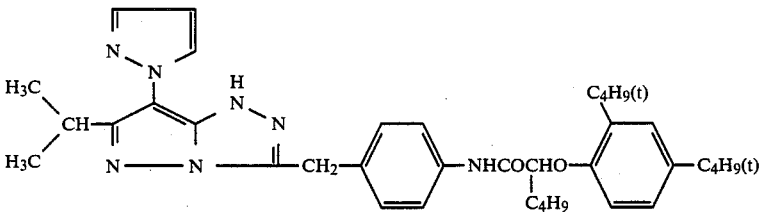

-continued
26
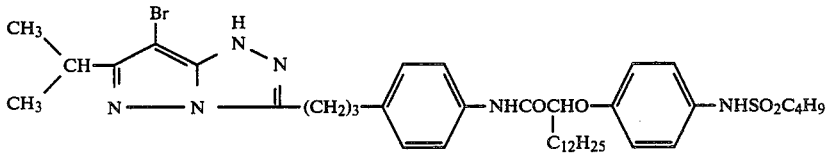
27
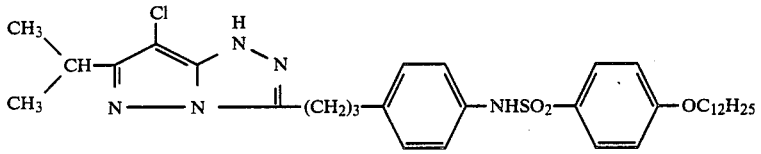
28
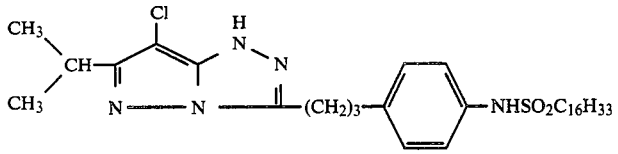
29
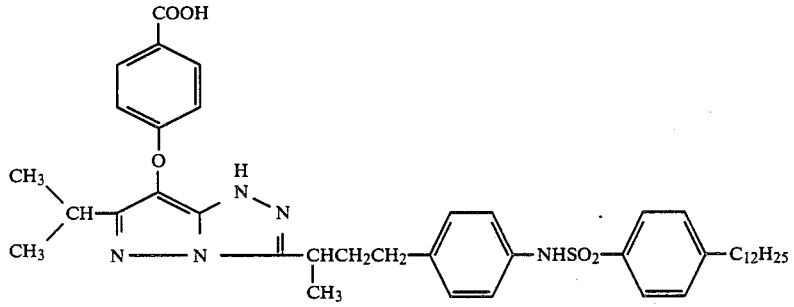
30
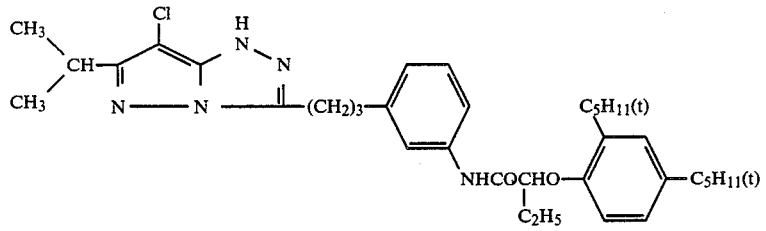
31
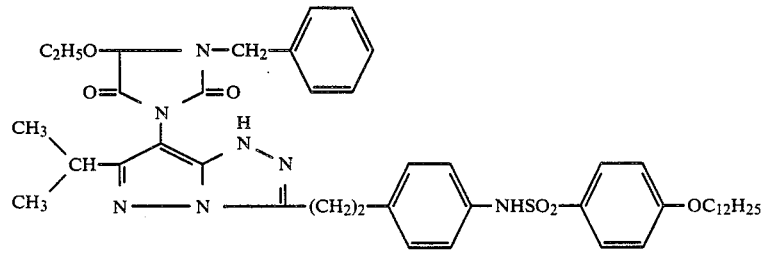

-continued
32
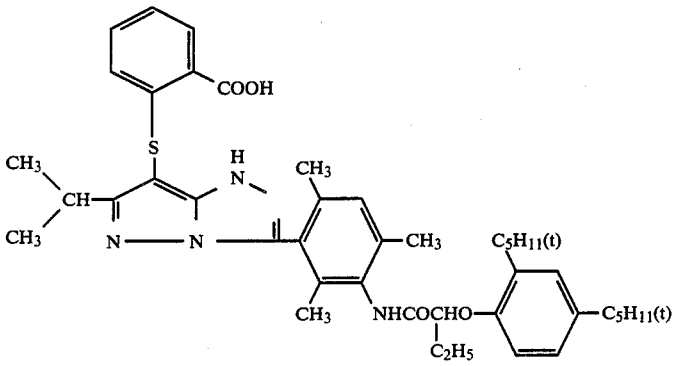
33
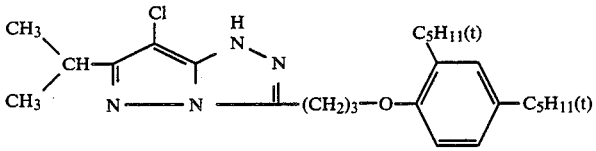
34
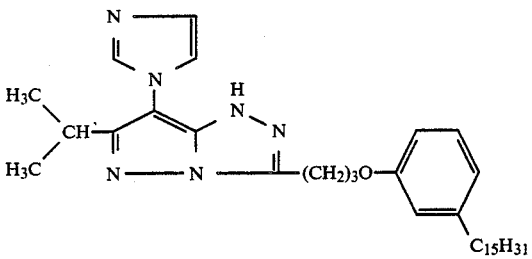
35
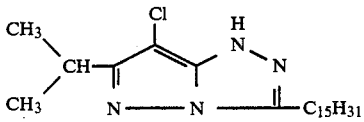
36
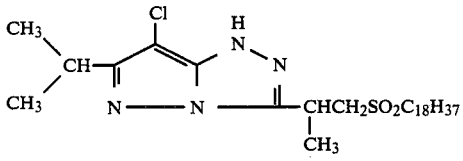
37
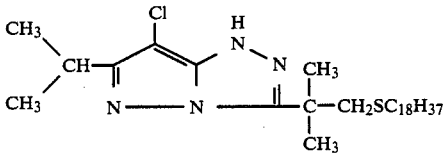
38
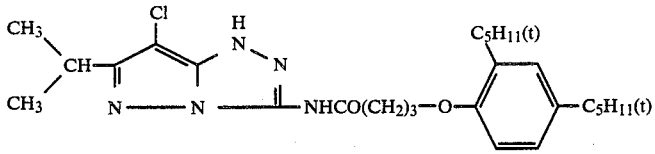
39
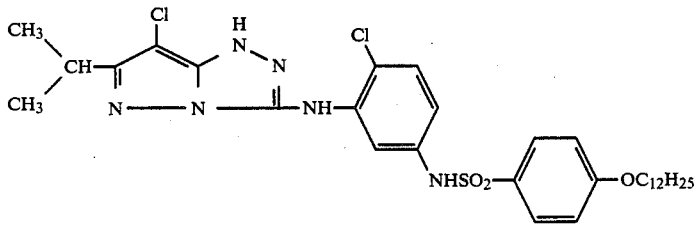
40
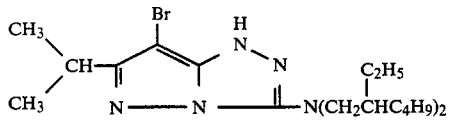
41
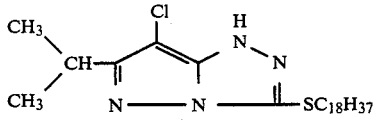

-continued
42
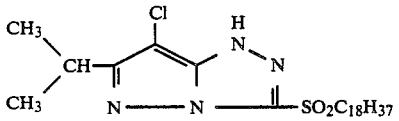
43
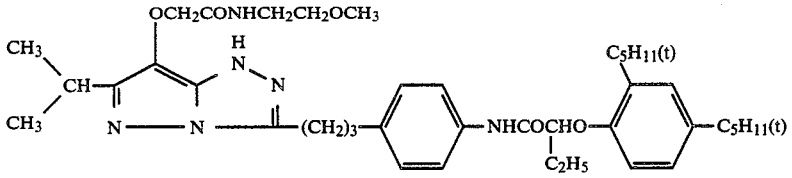
44
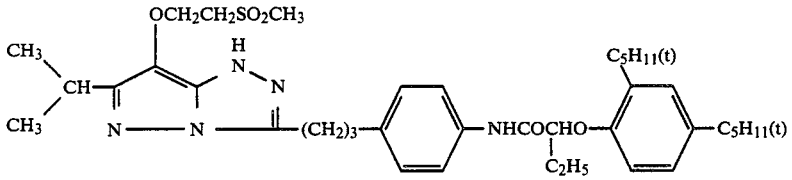
45
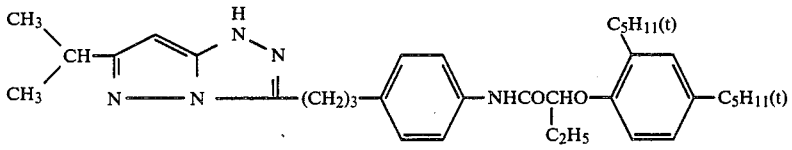
46
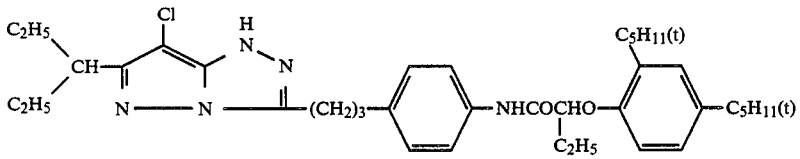
47
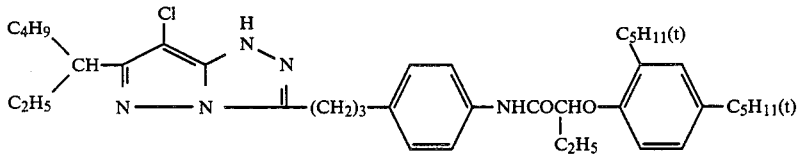
48
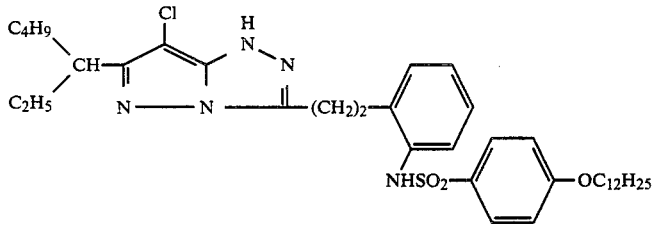
49
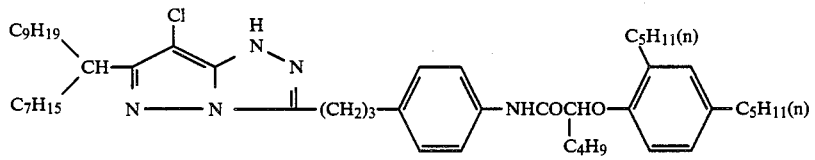
50
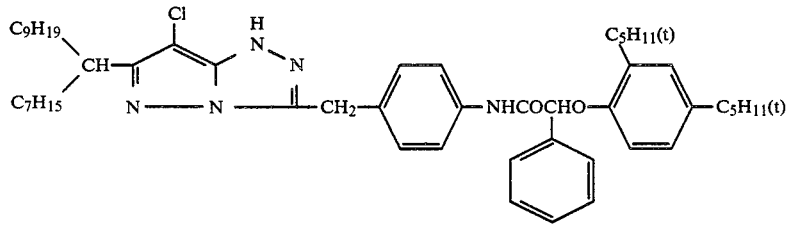

-continued
51
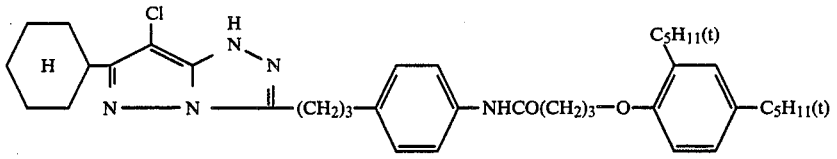
52
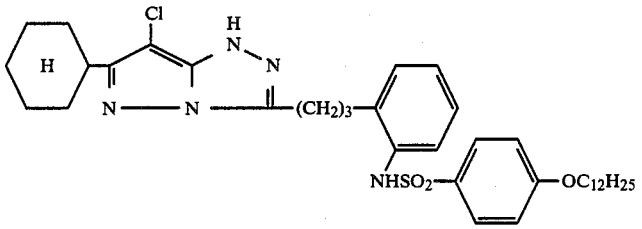
53
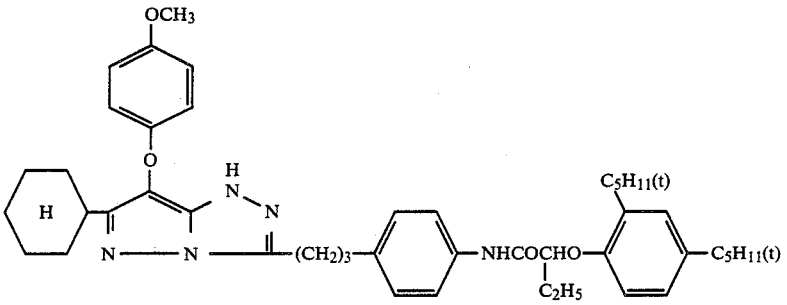
54
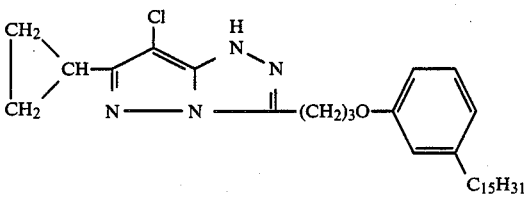
55
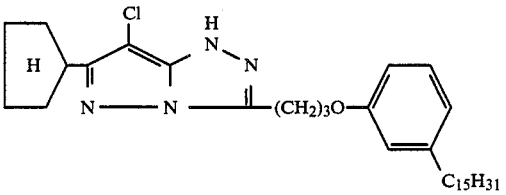
56
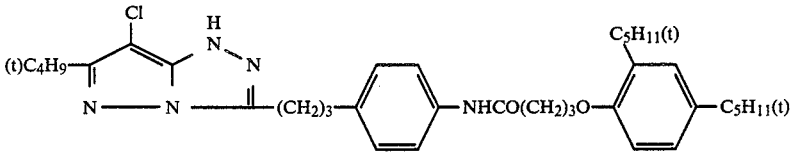
57
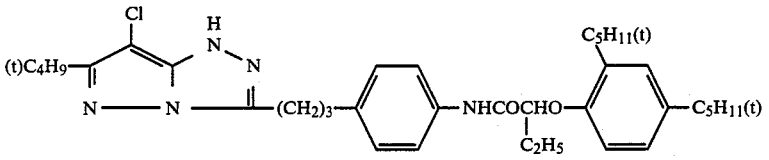
58
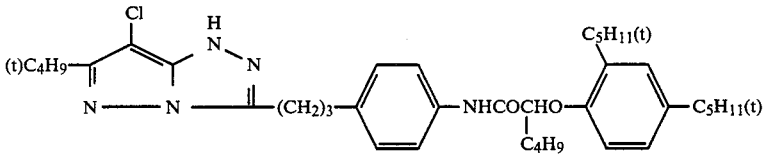

-continued
59
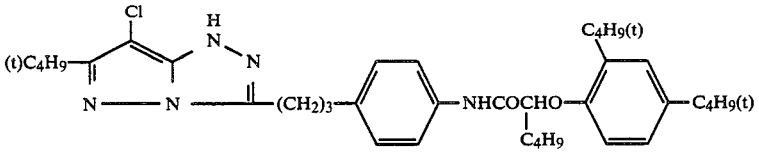
60
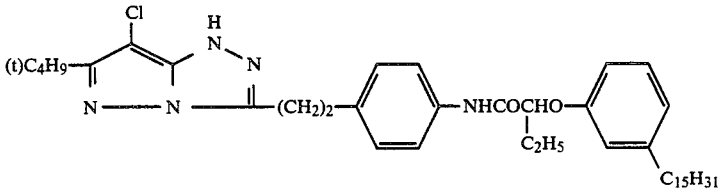
61
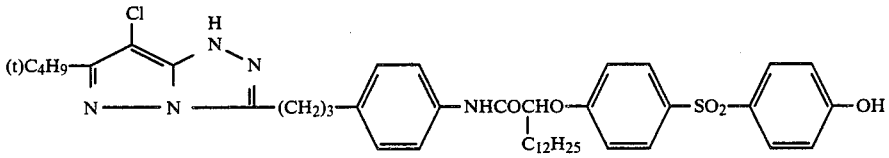
62
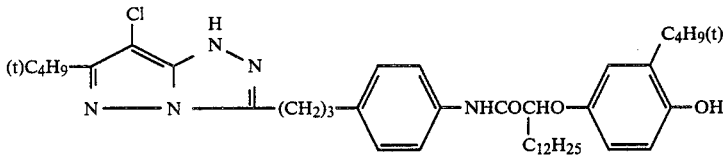
63
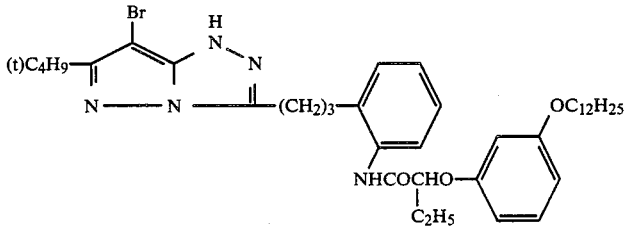
64
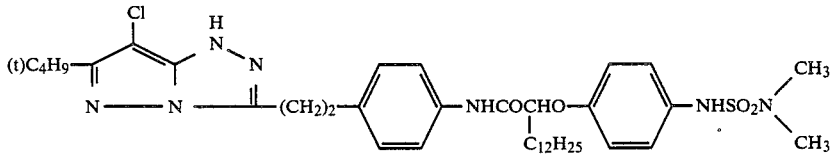
65
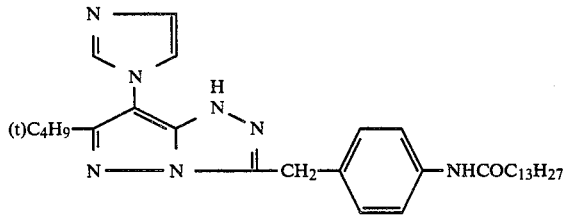
66
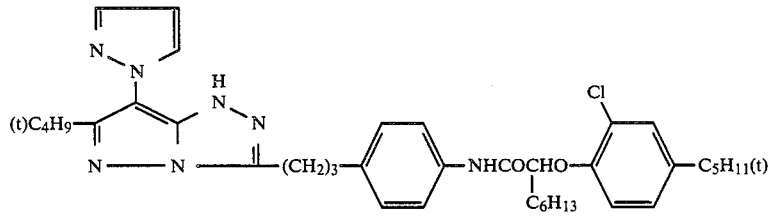

-continued
67
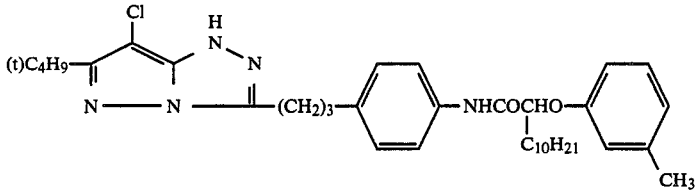
68
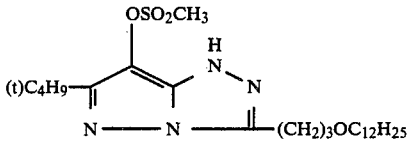
69
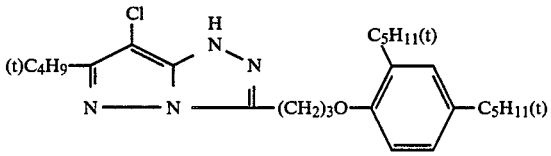
70
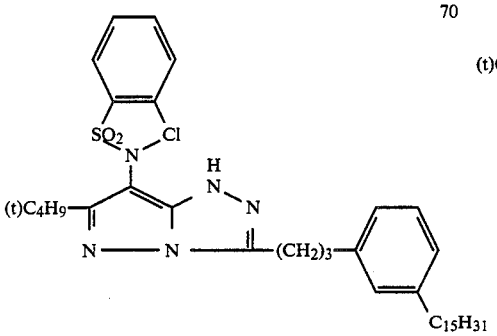
71
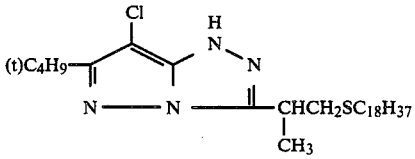
72
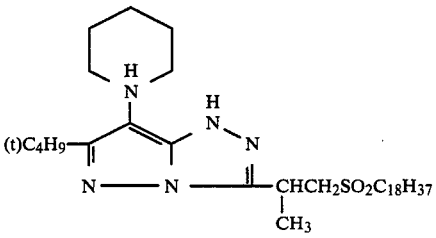
73
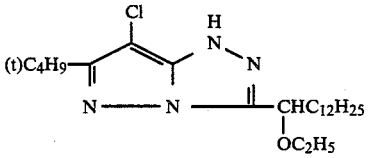
74
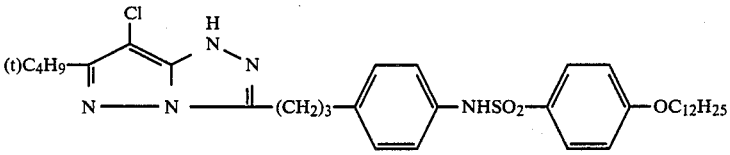
75
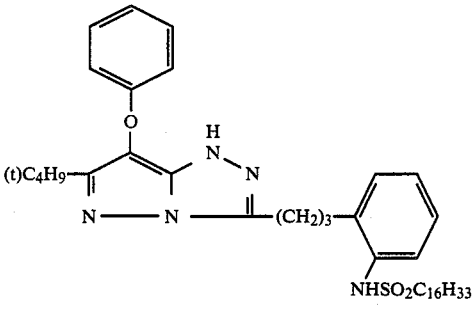
76
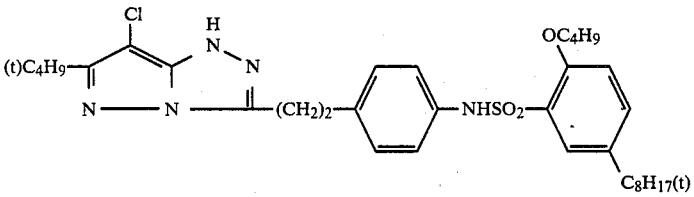

-continued
77
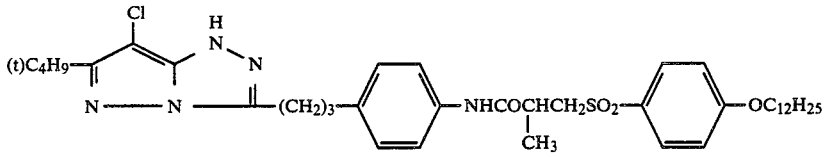
78
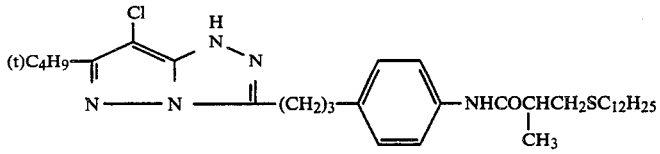
79
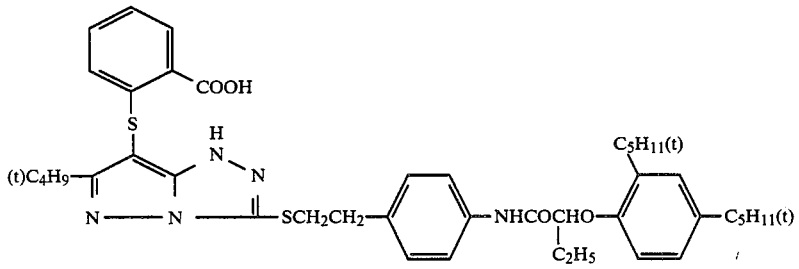
80
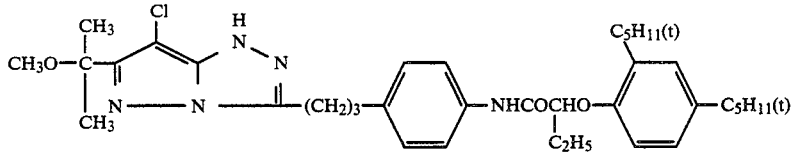
81
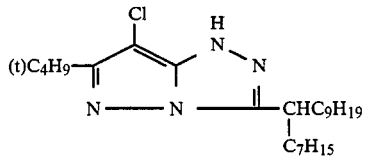
82
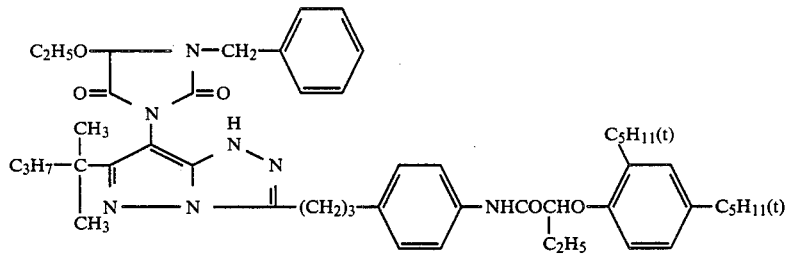
83
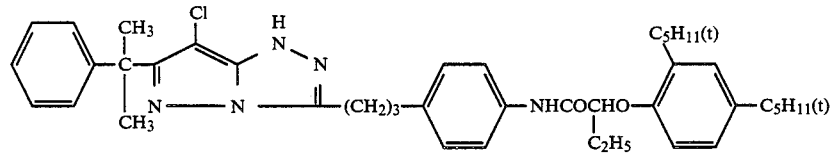
84
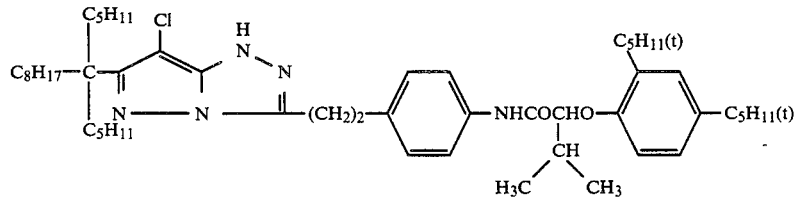

-continued
85
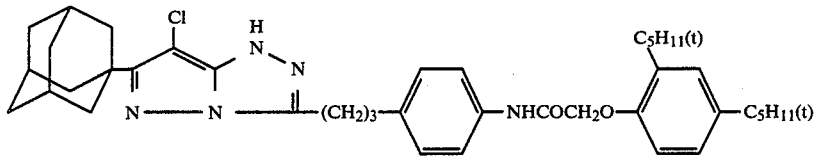
86
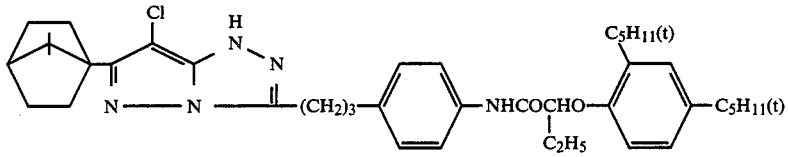
87
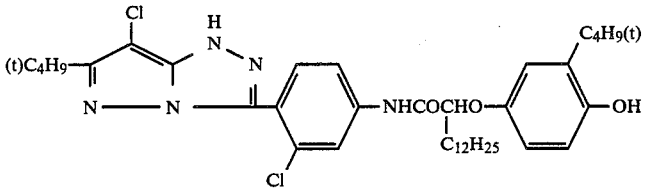
88
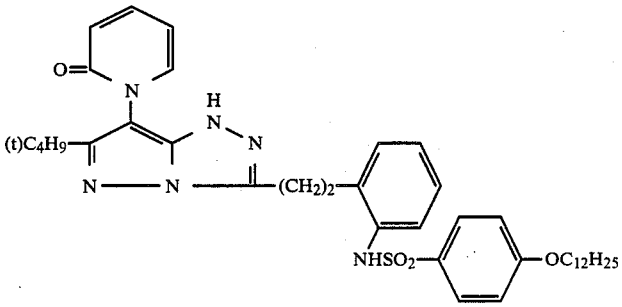
89
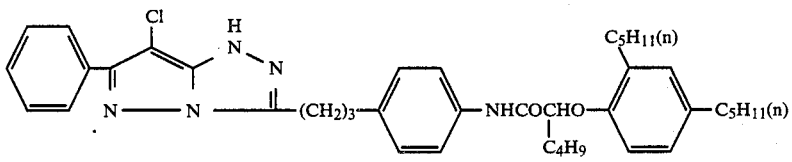
90
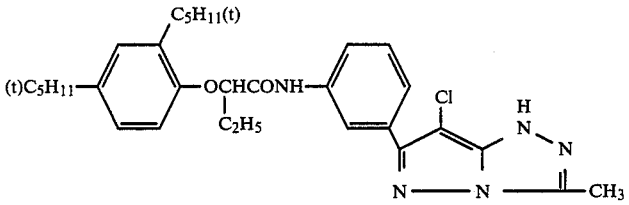
91
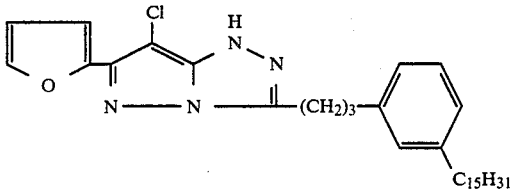

-continued
92
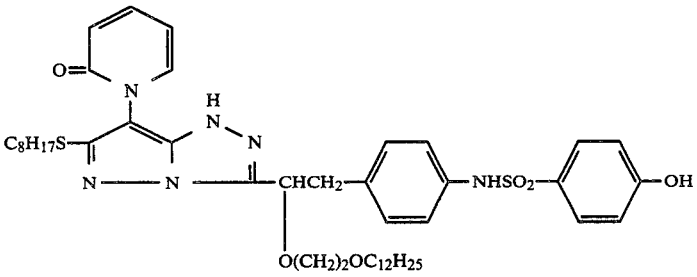
93
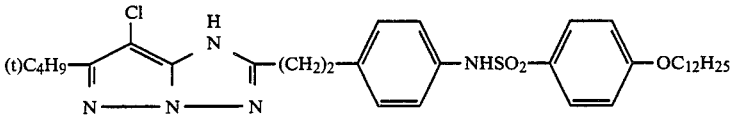
94
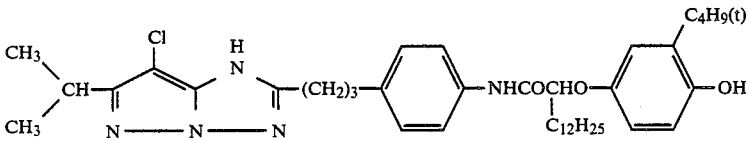
95
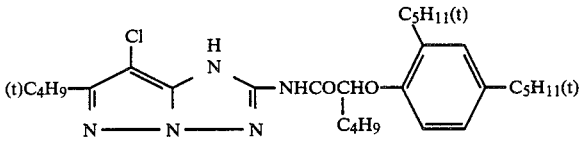
96
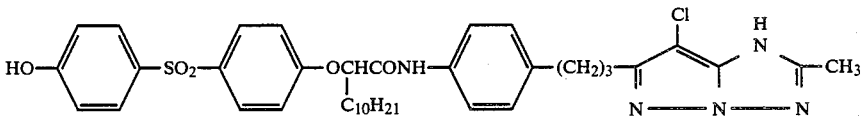
97
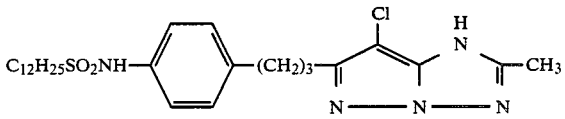
98
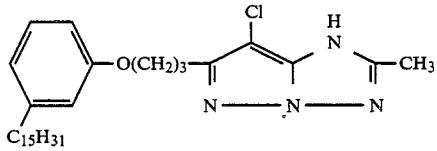
99
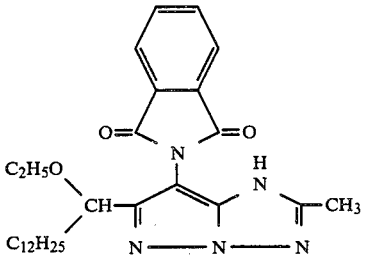
100
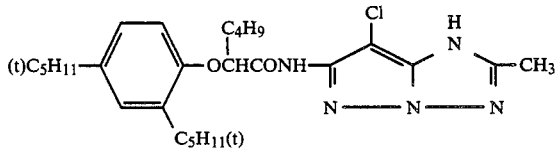
101
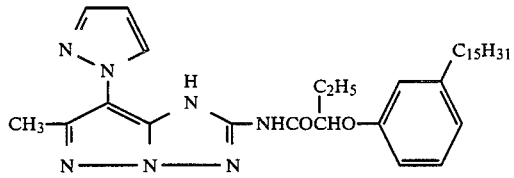

-continued
102
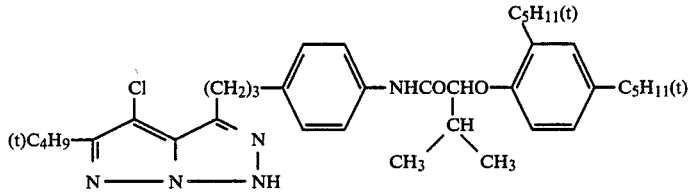
103
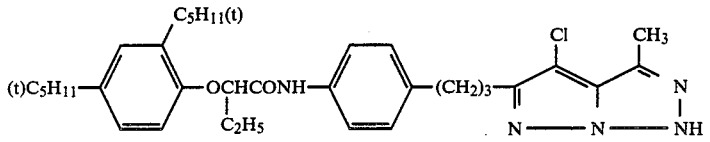
104
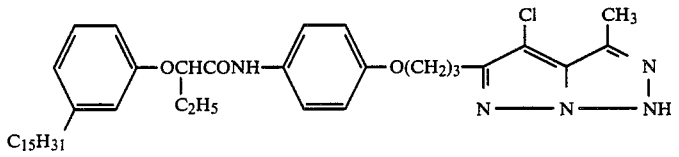
105
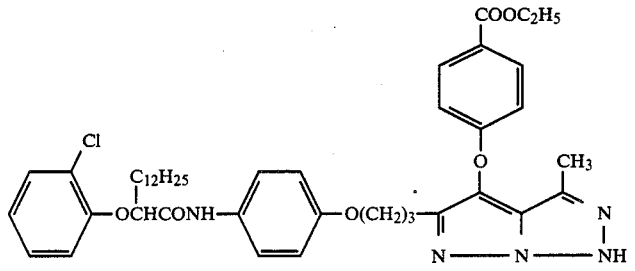
106
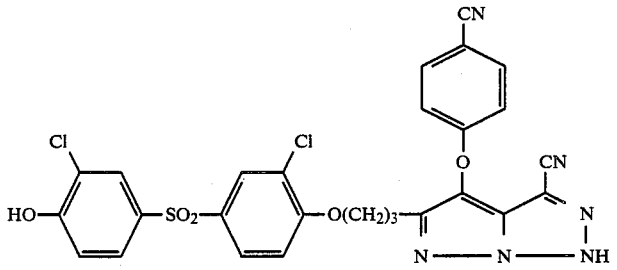
107
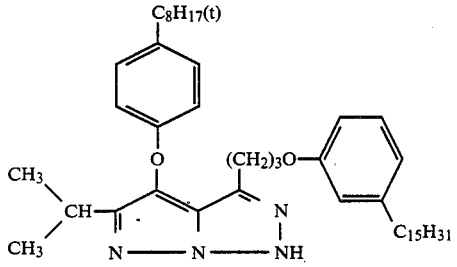

-continued
108
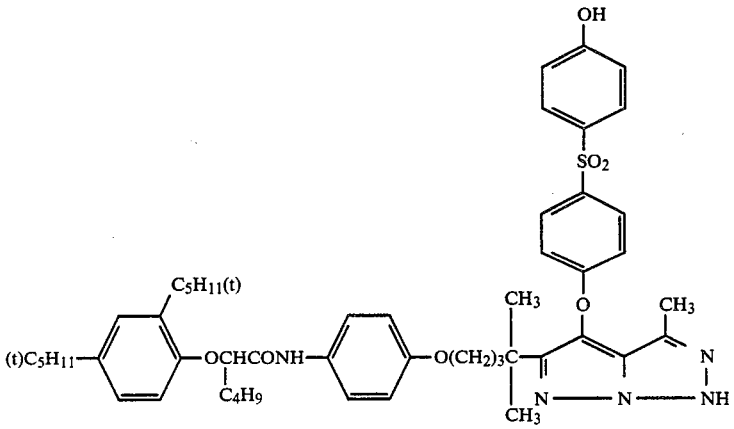
109
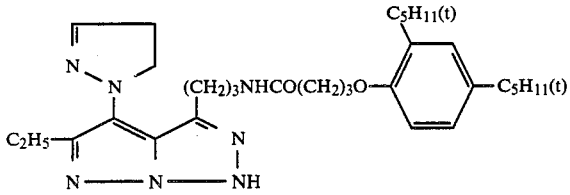
110
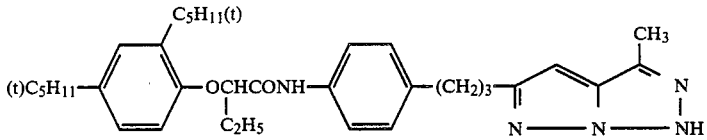
111
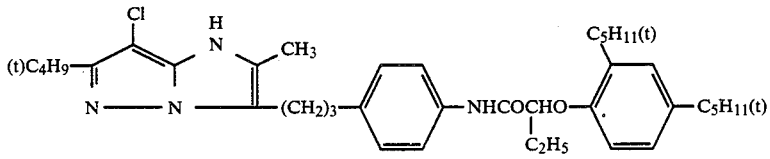
112
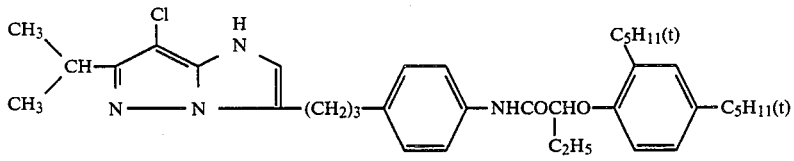
113
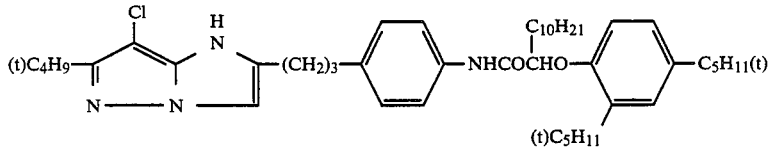
114
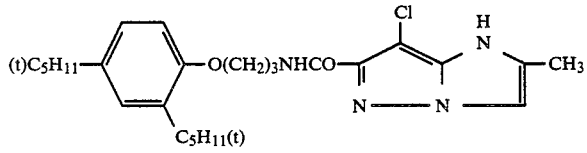
115
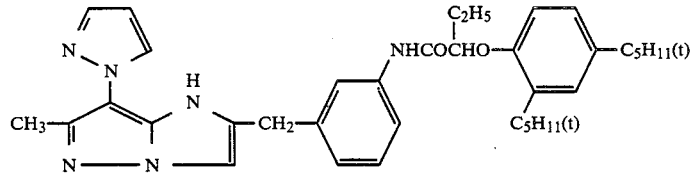

-continued
116
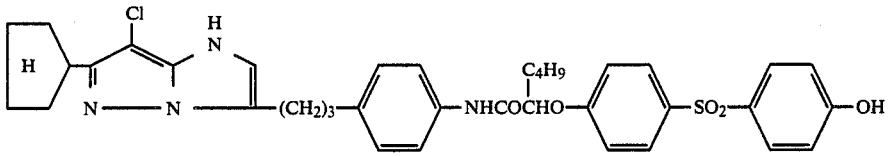
117
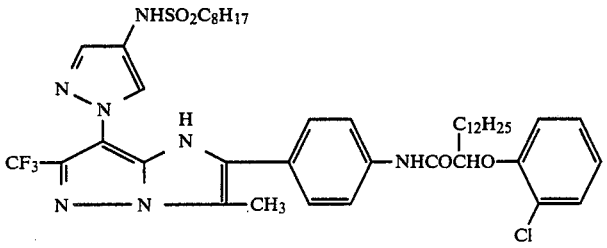
118
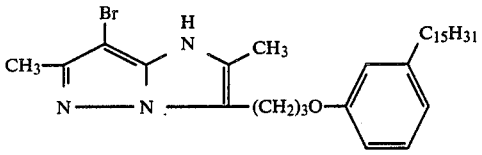
119
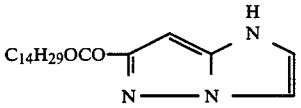
120
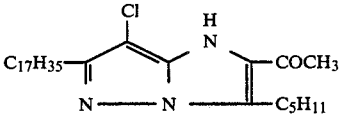
121
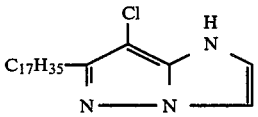
122
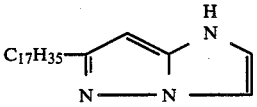
123
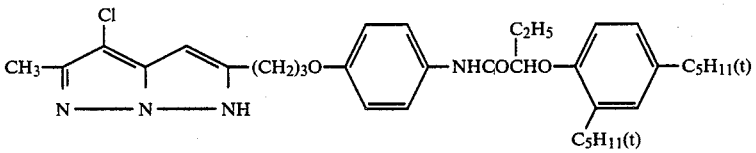
124
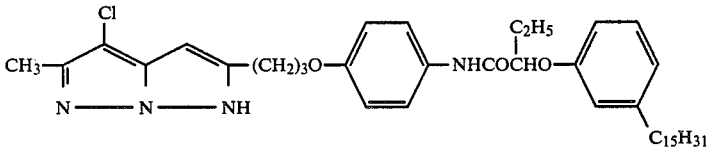
125
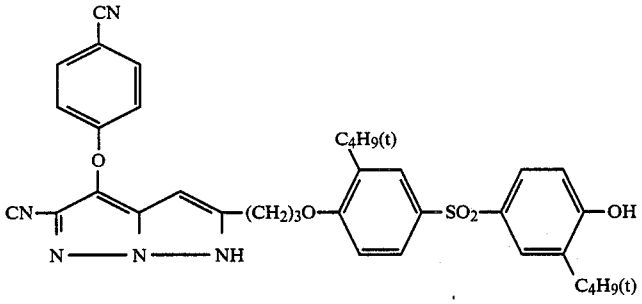

-continued
126
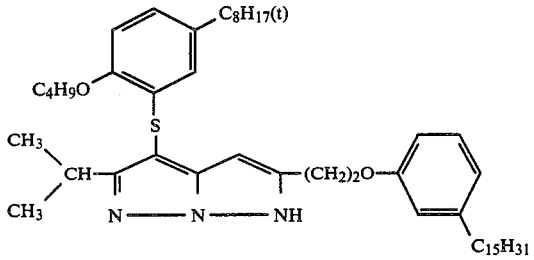
127
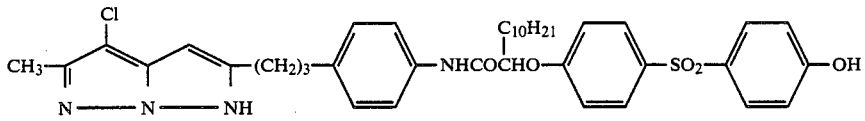
128
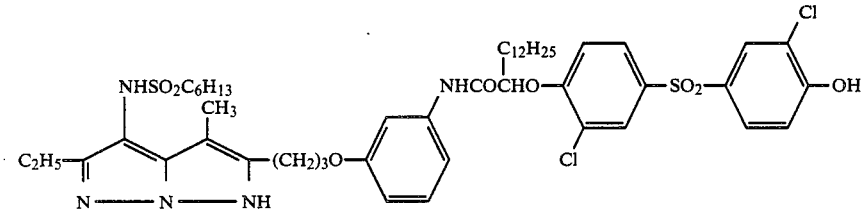
129
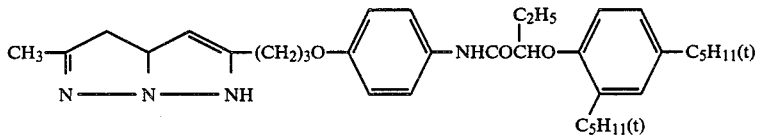
130
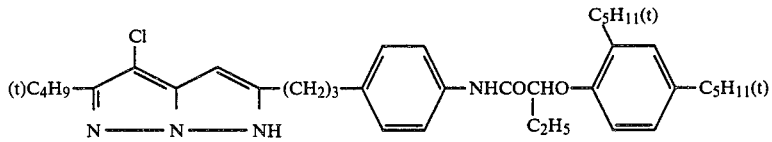
131
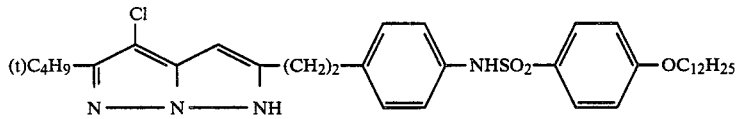
132
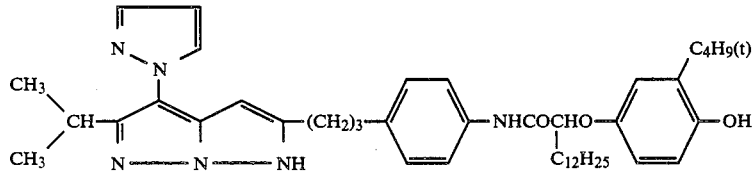
133
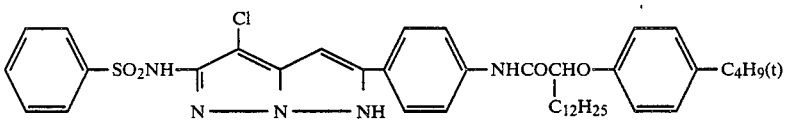

-continued
134
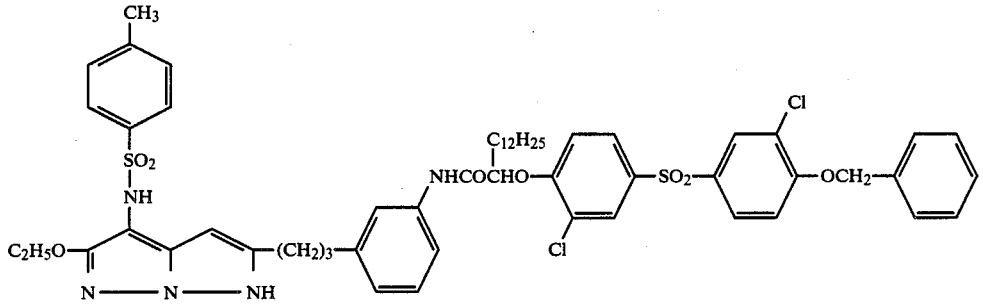
135
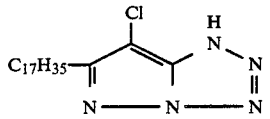
136
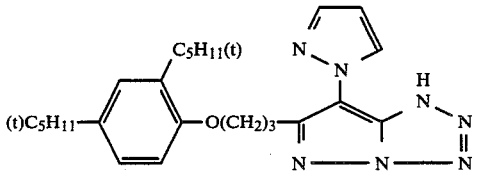
137
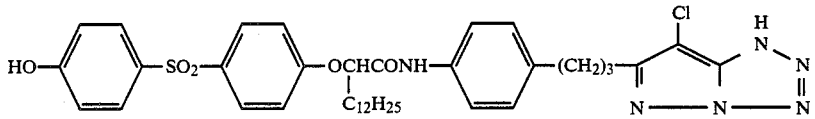
138
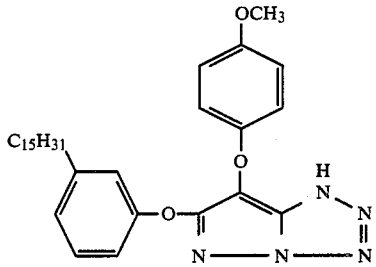
139
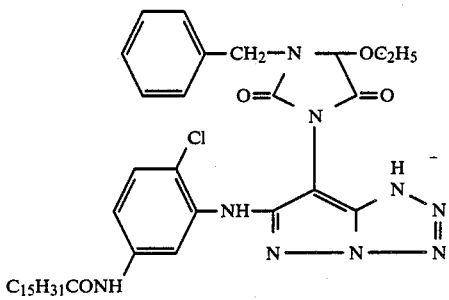
140
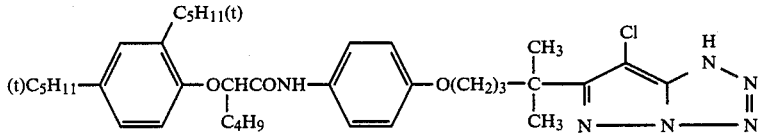
141
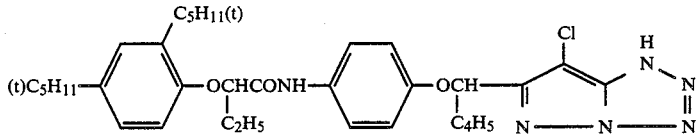
142
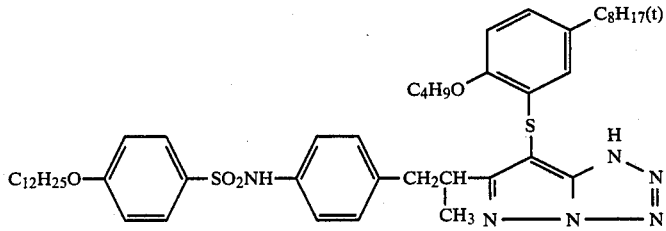
143
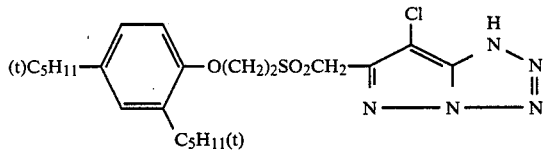

-continued
144
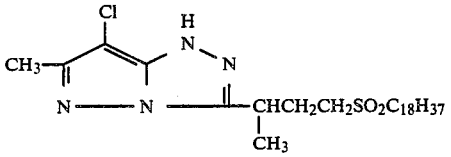
145
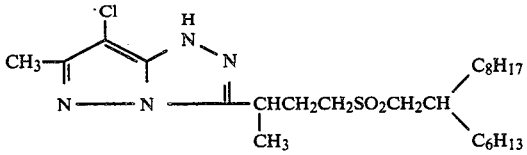
146
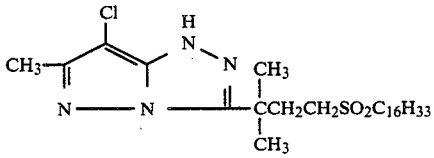
147
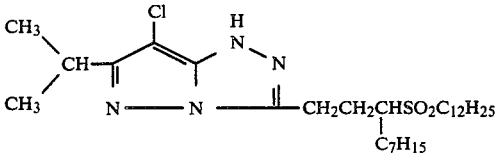
148
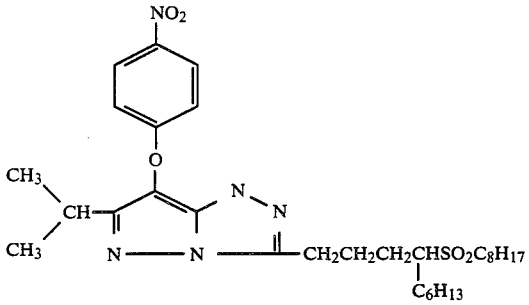
149
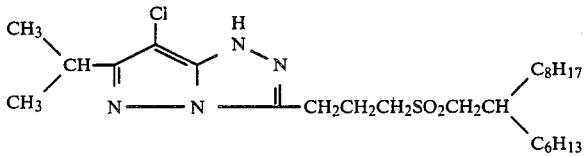
150
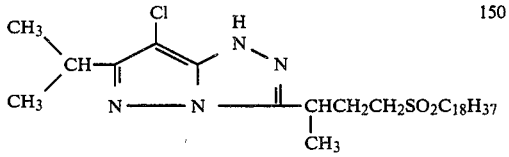
151
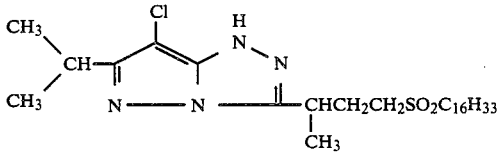
152
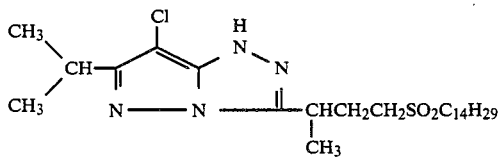
153
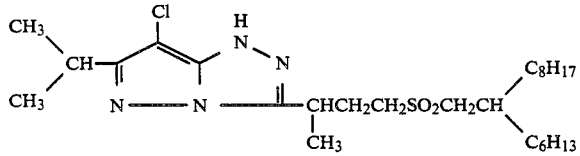
154
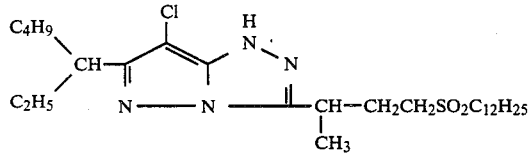

-continued
155
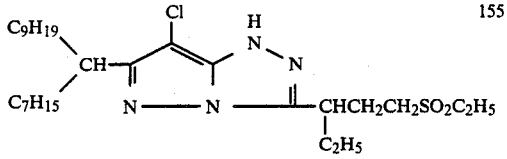
156
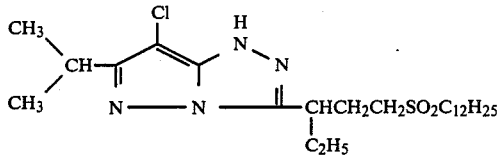
157
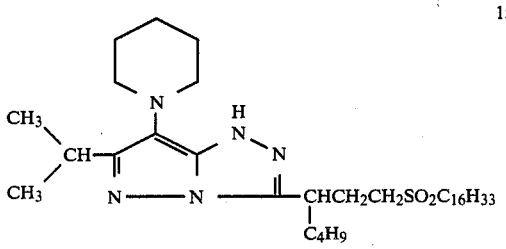
158
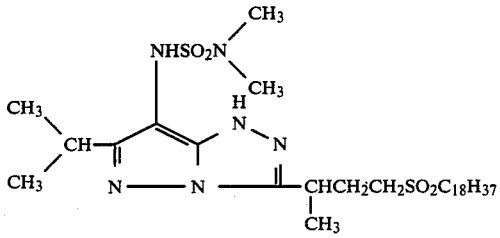
159
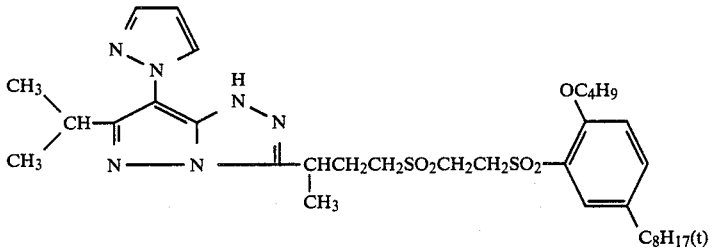
160
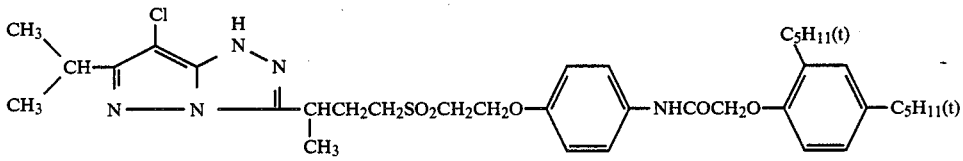
161
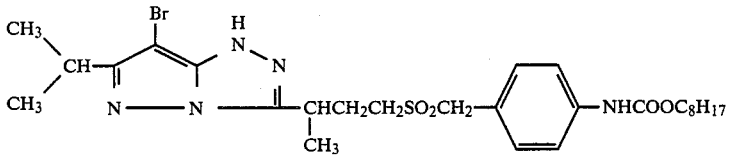
162
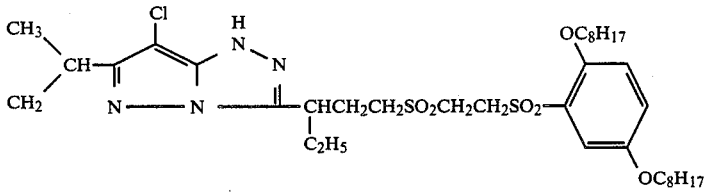
163
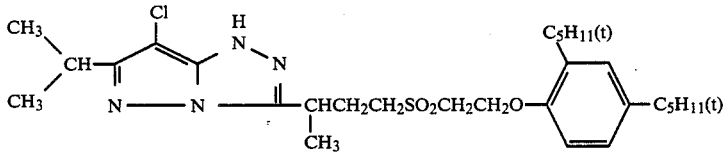
164
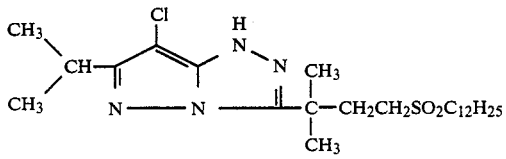

-continued
165
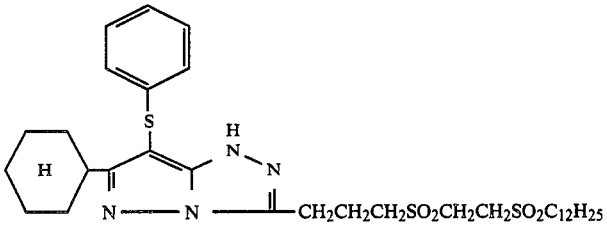
166
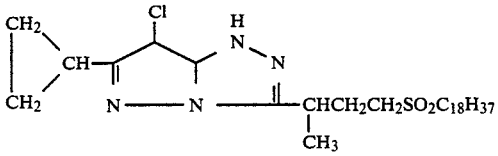
167
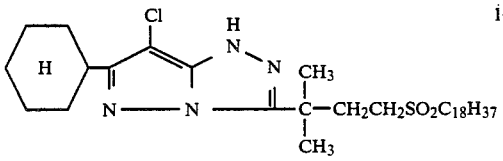
168
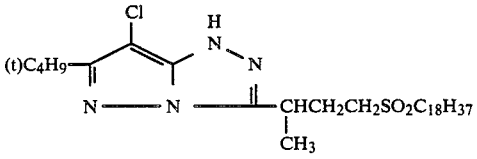
169
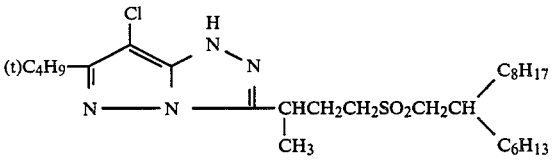
170
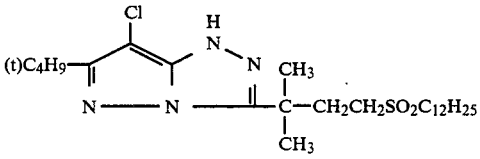
171
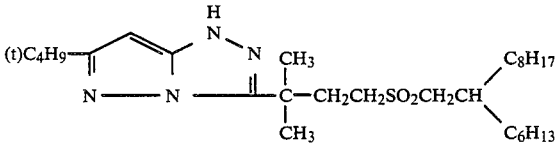
172
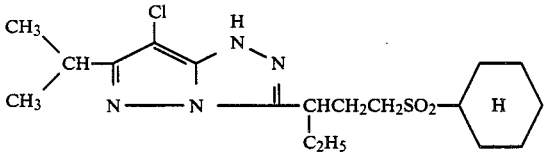
173
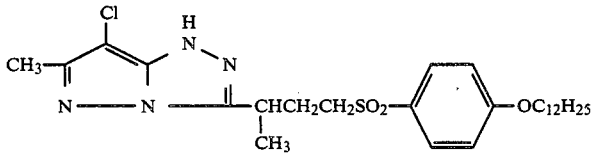
174
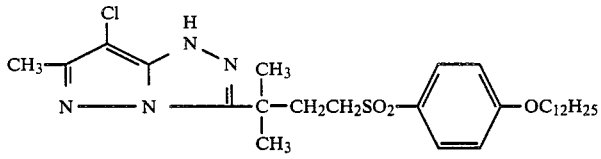

-continued
175
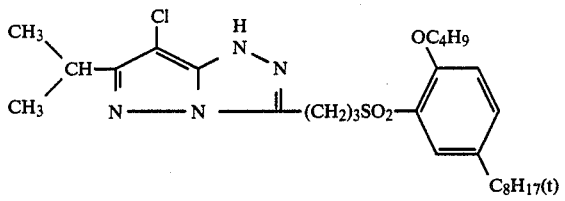
176
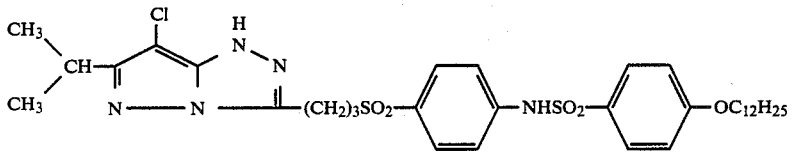
177
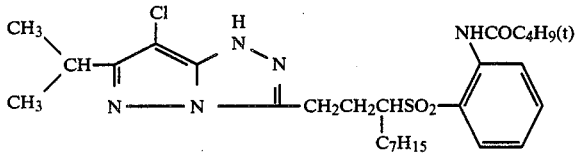
178
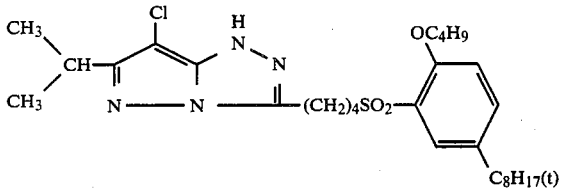
179
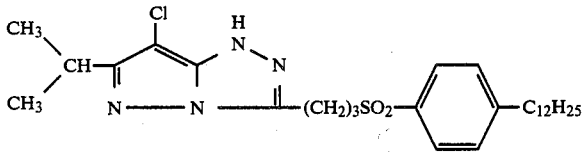
180
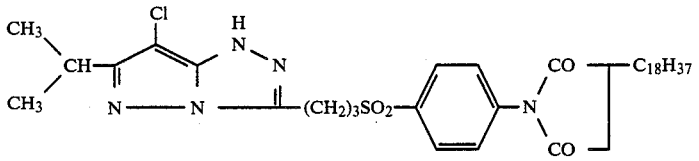
181
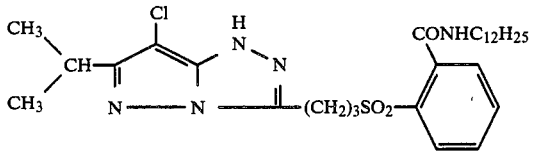
182
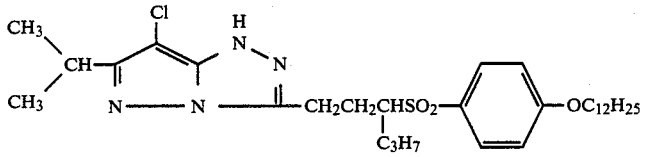
183
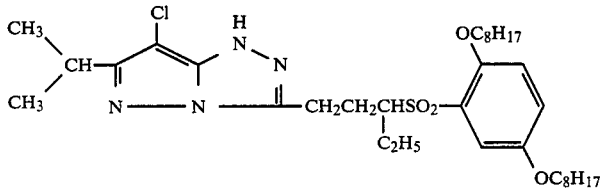

-continued
184
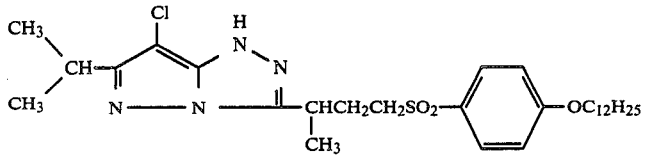
185
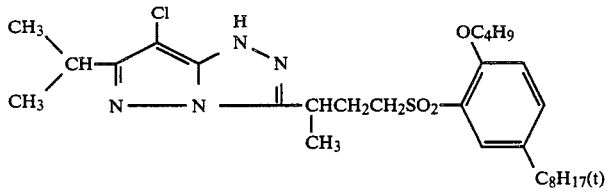
186
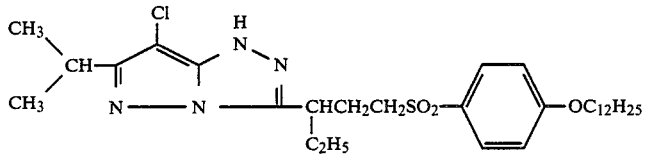
187
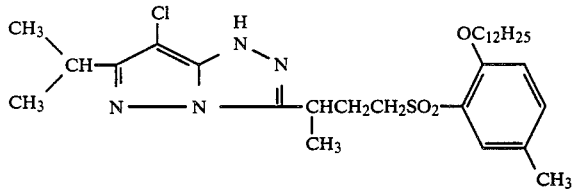
188
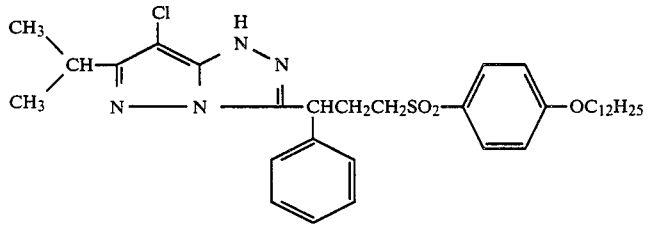
189
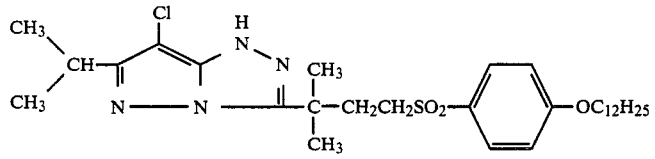
190
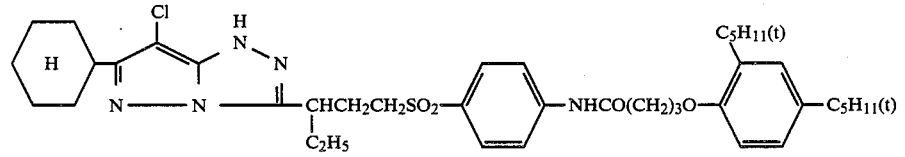
191
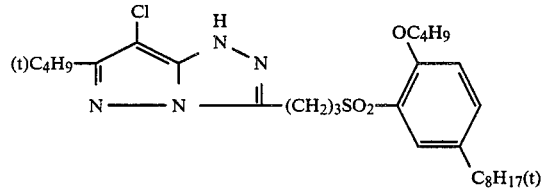

-continued
192
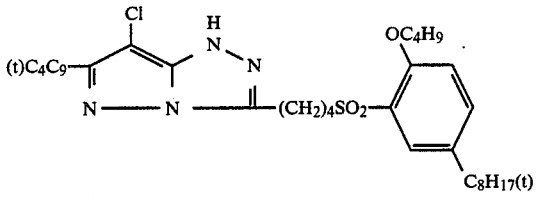
193
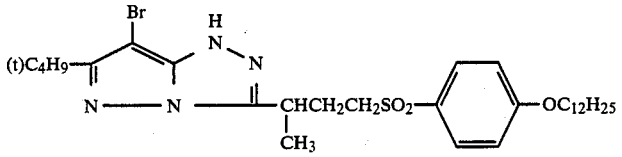
194
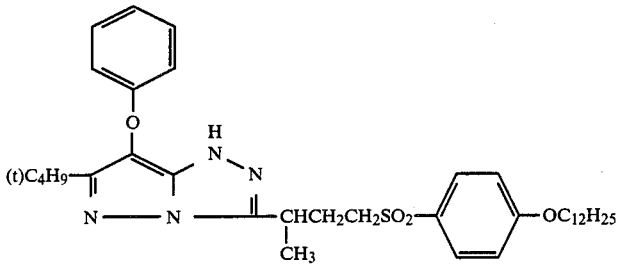
195
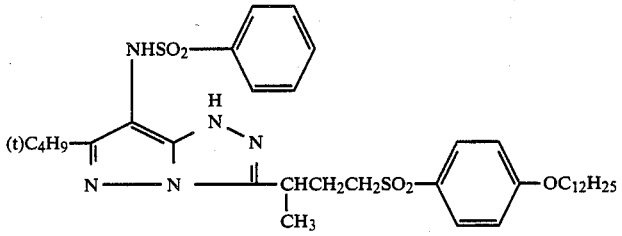
196
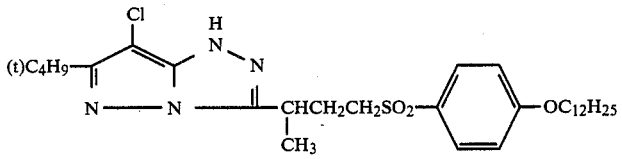
197
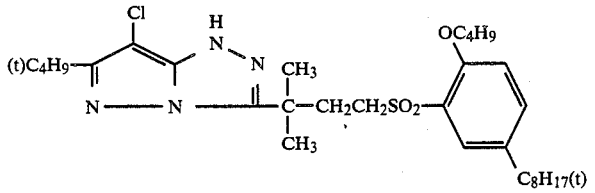
198
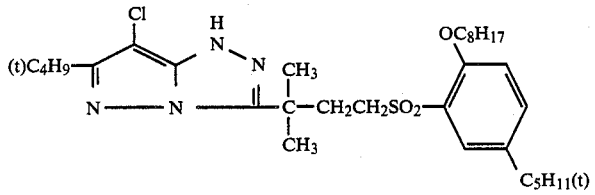

-continued
199
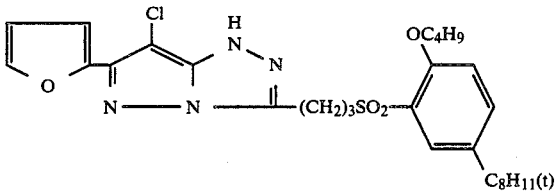
200
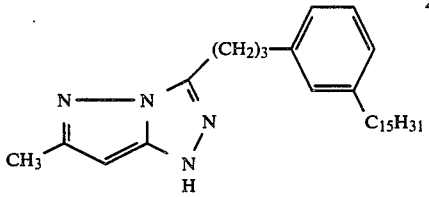
201
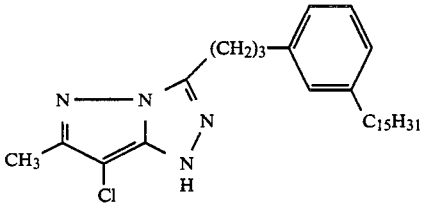
202
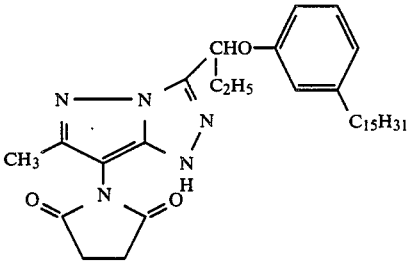
203
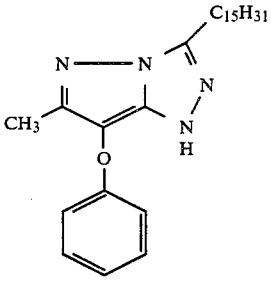
204
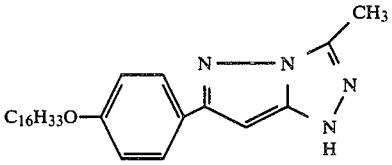
205
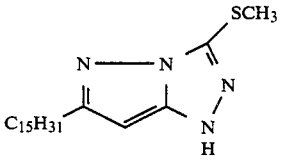
206
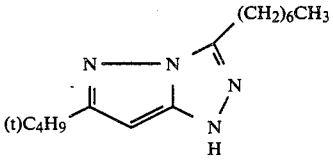
207
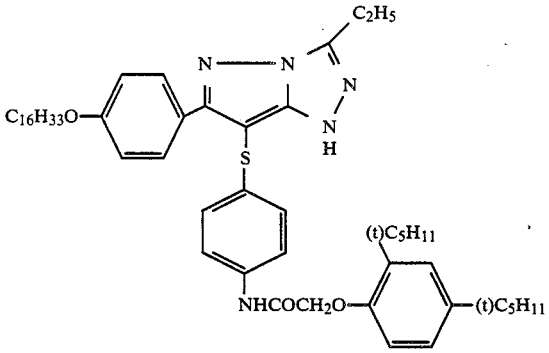
208
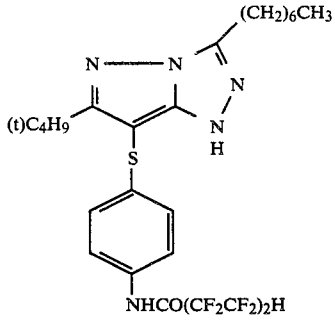
209
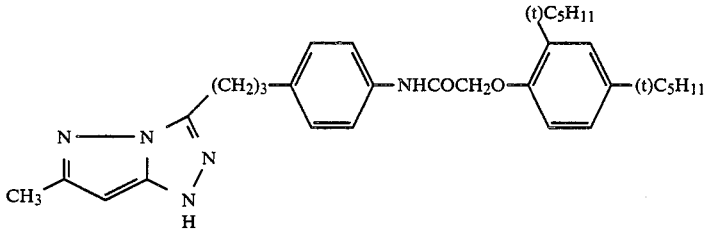

-continued
210
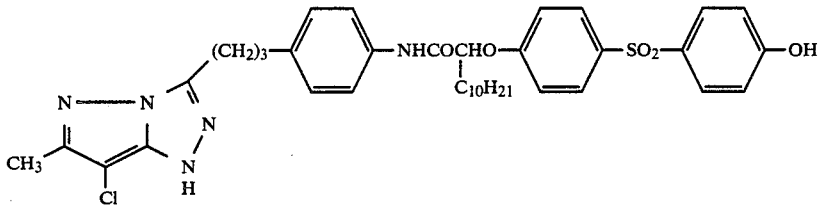
211
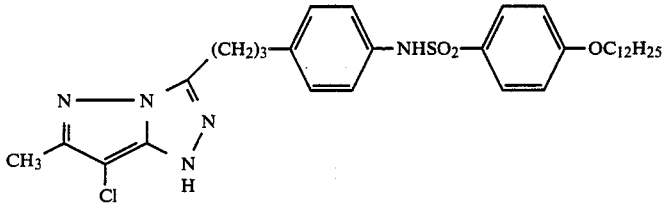
212
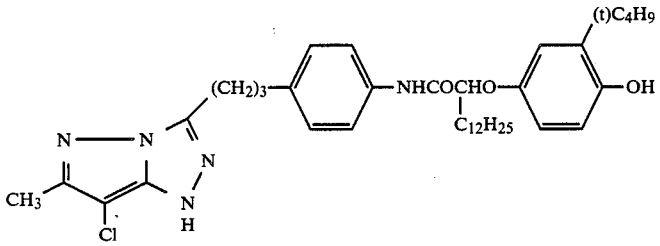
213
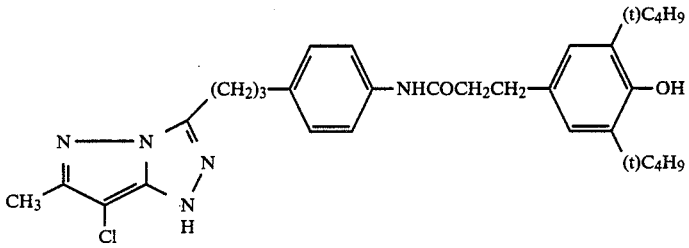
214
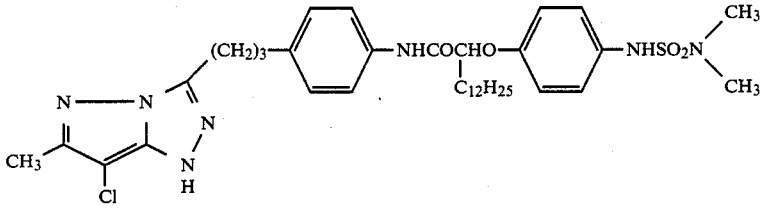
215
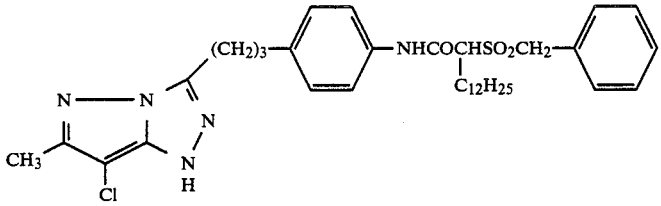
216
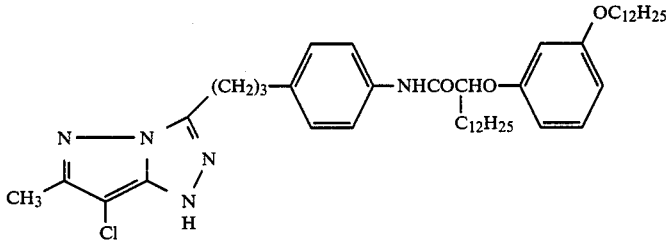

-continued
217
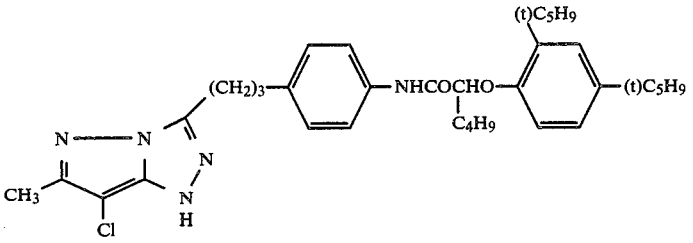
218
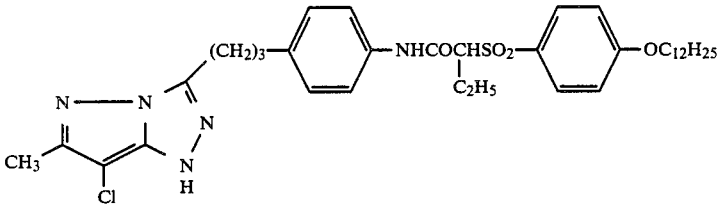
219
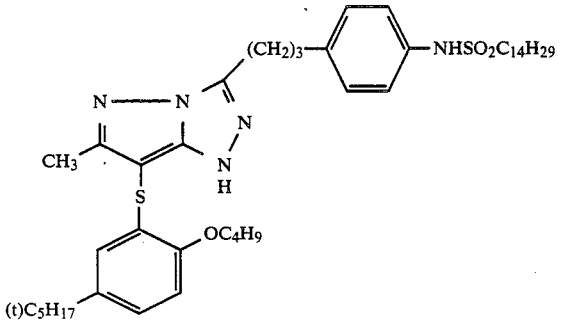
220
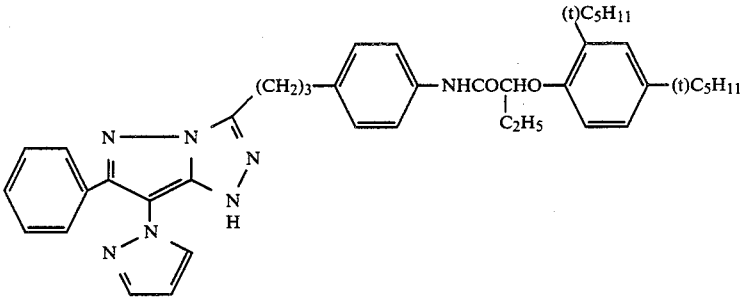
221
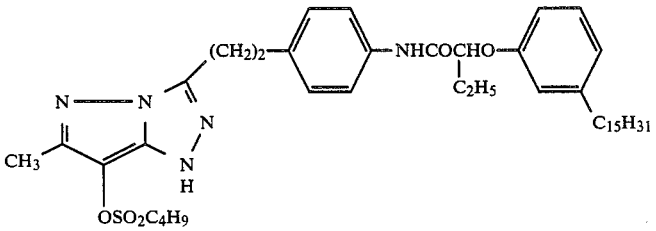

-continued
222
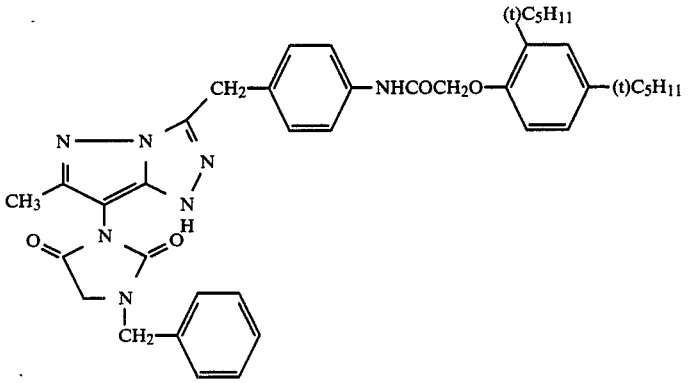
223
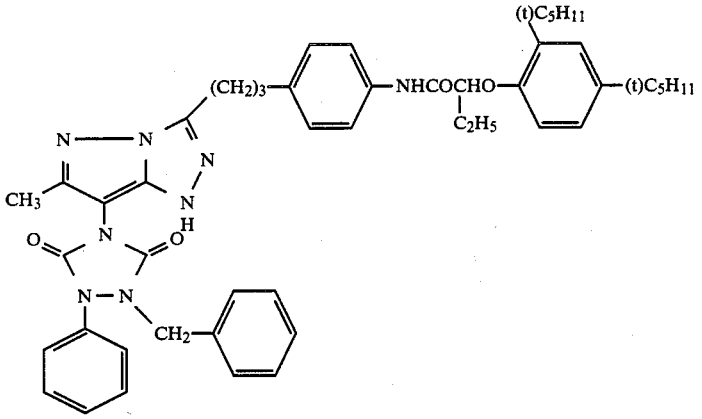
224
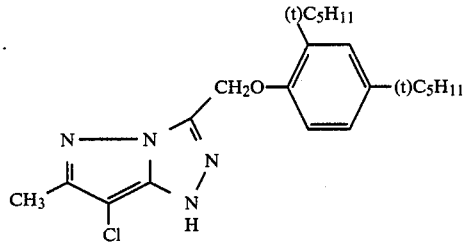
225
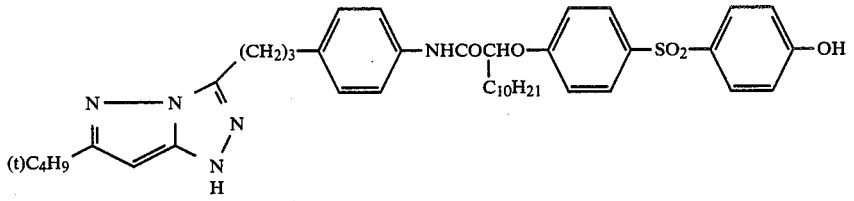
226
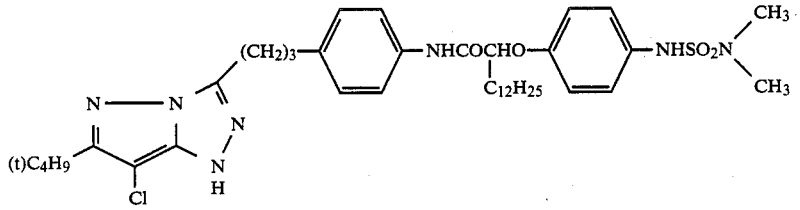

-continued

227

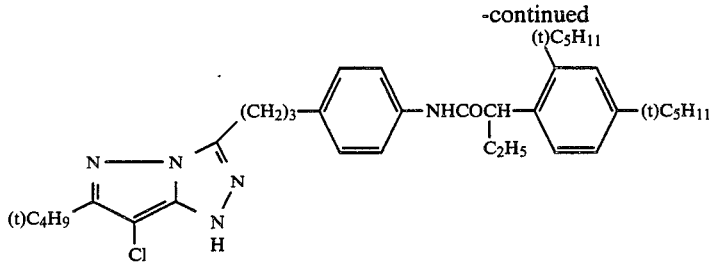

228

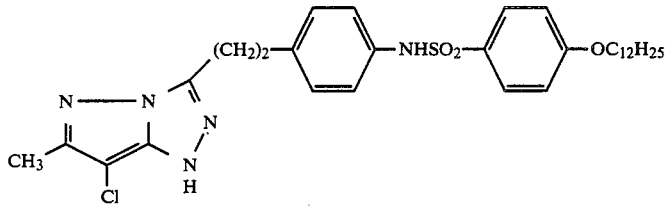

229

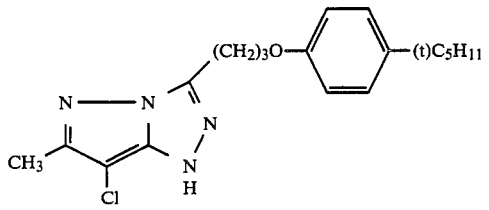

230

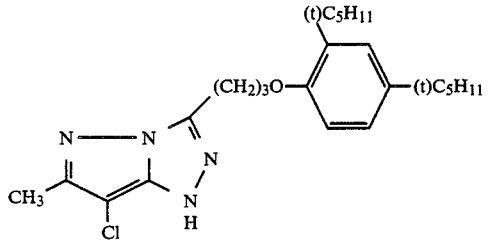

231

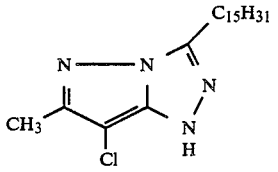

232

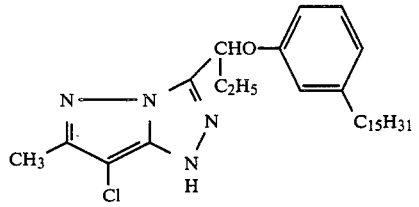

233

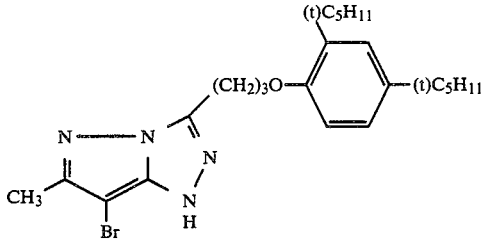

These couplers were synthesized by reference to Journal of the Chemical Society, Perkin I (1977), pages 2047 to 2052, U.S. Pat. No. 3,725,067 and Unexamined Published Japanese Patent Application Nos. 99437/1984, 42045/1983, 162548/1984, 59171956/1984, 33552/1985 and 43659/1985.

The coupler of the present invention is usually incorporated in an amount within the range of $1\times10^{-3}$ mole to 1 mole, preferably $1\times10^{-2}$ mole to $8\times10^{-1}$ mole, per mole of silver halide.

The coupler of the present invention may be used in combination with any other type of magenta coupler.

When the silver halide photographic material of the present invention is used as a multicolor photographic materials, yellow and cyan couplers which are extensively used in the photographic filed other than the magenta coupler of the present invention may be used in the ordinary mode of use. Also, any colored coupler which has an effect of color correction may be used optionally. In order to satisfy the characteristics required of photographic materials, two or more of said couplers may be incorporated together in the same layer, or the same coupler may be incorporated in two or more different layers.

Magenta dye image stabilizers to be used in combination with the coupler of the present invention are compounds represented by the following formula (XI) which have both an effect of preventing the color fading due to light and an effect of preventing the discoloration due to light of magenta dye images:

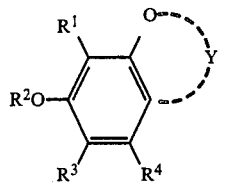

(XI)

wherein $R^1$ and $R^4$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamido group or an alkoxycarbonyl group;

$R^2$ represents a hydrogen atom, an alkyl group, an alkenyl group, an aryl group, an acyl group, a cycloalkyl group or a heterocyclic group;

$R^3$ represents a hydrogen atom, a halogen atom, an alkyl group, an alkenyl group, an aryl group, an aryloxy group, an acyl group, an acylamino group, an acyloxy group, a sulfonamide group, a cycloalkyl group or an alkoxycarbonyl group;

$R^2$ and $R^3$ may cooperate to form a 5- or 6-membered ring; and

Y represents the group of atoms necessary to form a chroman or cumaran ring.

Hereinafter, unless otherwise specifically indicated, the compounds represented by formula (XI) of the present invention are referred to as magenta dye image stabilizers.

The groups mentioned above may be substituted by other substituents, respectively, such as, for example, alkyl, alkenyl, alkoxy, aryloxy, hydroxy, alkoxycarbonyl, aryloxycarbonyl, acylamino, carbamoyl, sulfonamide and sulfamoyl groups.

$R^2$ and $R^3$ may cooperate to form a 5- or 6-membered ring, or may cooperate to form a methylenedioxy ring.

Y represents the group of atoms necessary to form a chroman or cumaran ring.

The chroman or cumaran ring may have a substituent such as a halogen atom, an alkyl group, a cycloalkyl group, an alkoxy group, an alkenyl group, an alkenyloxy group, a hydroxy group, an aryl group, an aryloxy group or a heterocyclic ring, and further may form a spiro ring.

Of the compounds represented by formula (XI), those which are particularly useful in the present invention are compounds represented by the following formulas (XII), (XIII), (XIV), (XV) ad (XVI):

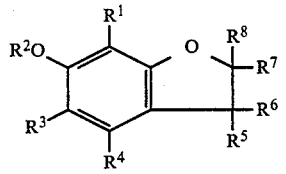

(XII)

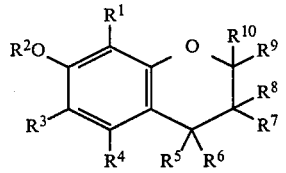

(XIII)

-continued

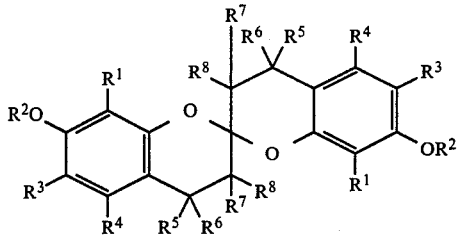

(XIV)

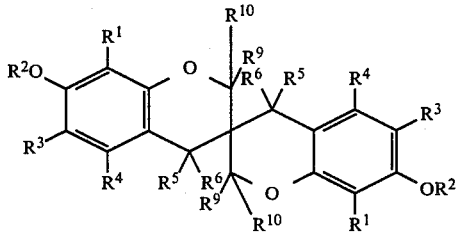

(XV)

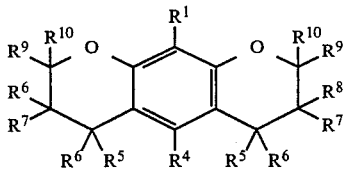

(XVI)

wherein $R^1$, $R^2$, $R^3$ and $R^4$ are the same in meaning as $R^1$, $R^2$, $R^3$ and $R^4$ in formula (XI); and $R^5$, $R^6$, $R^7$, $R^8$, $R^9$ and $R^{10}$ each represents a hydrogen atom, a halogen atom, an alkyl group, an alkoxy group, a hydroxy group, an alkenyl group, an alkenyloxy group, an aryl group, an aryloxy group or a heterocyclic group.

$R^5$ and $R^6$, $R^6$ and $R^7$, $R^7$ and $R^8$, $R^8$ and $R^9$, and $R^9$ and $R^{10}$ each may cooperate to form a carbon ring, which ring may be substituted by an alkyl group.

Particularly useful are compounds wherein $R^1$ and $R^4$ in formulas (XII), (XIII), (XIV), (XV) and (XVI) each represents a hydrogen atom, an alkyl group, an alkoxy group, a hydroxy group or a cycloalkyl group, $R^2$ and $R^3$ each represents a hydrogen atom, an alkyl group or a cycloalkyl group, and $R^5$, $R^6$, $R^7$, $R^8$, $R^9$ and $R^{10}$ each represents a hydrogen atom, an alkyl group or a cycloalkyl group.

Typical, but by no means limiting, examples of such compounds which can be used in the present invention are listed below.

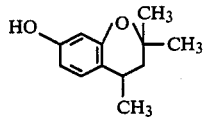

B-1

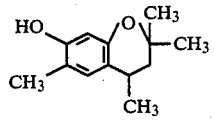

B-2

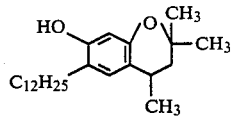

B-3

-continued
B-4
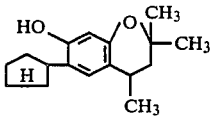
B-5
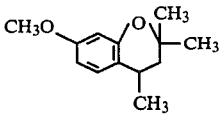
B-6
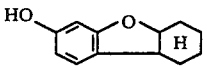
B-7
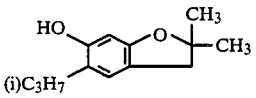
B-8
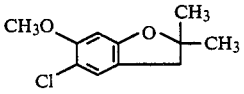
B-9
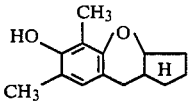
B-10
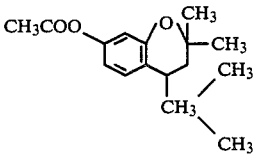
B-11
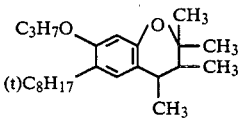
B-12
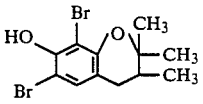
B-13
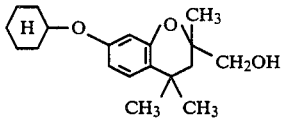
B-14
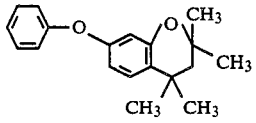
B-15
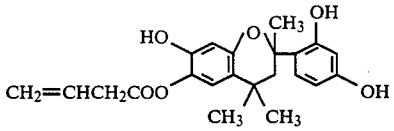
-continued
B-16
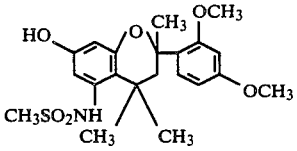
B-17
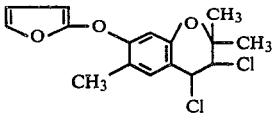
B-18
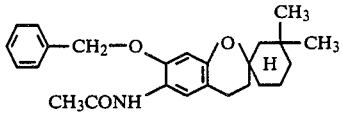
B-19
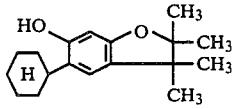
B-20
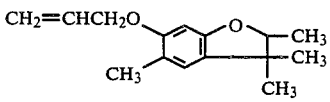
B-21
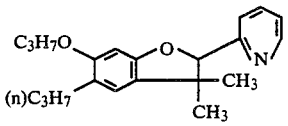
B-22
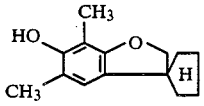
B-23
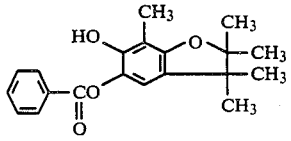
B-24
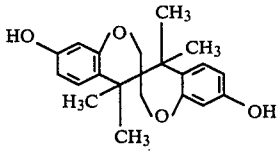
B-25
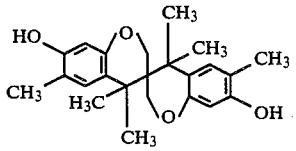
B-26
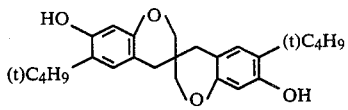

-continued
B-27
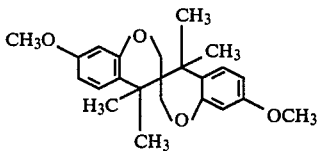
B-28
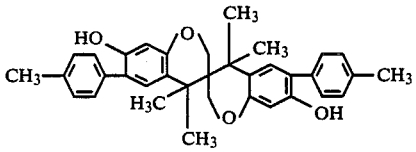
B-29
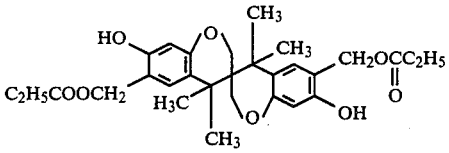
B-30
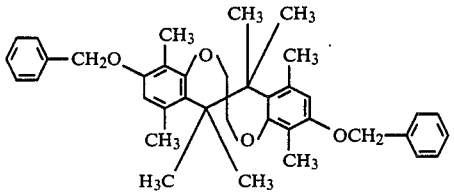
B-31
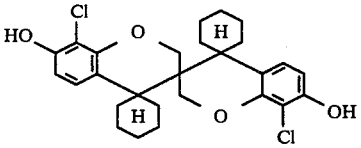
B-32
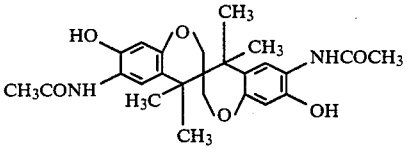
B-33
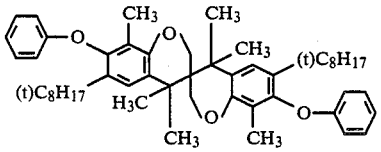
B-34
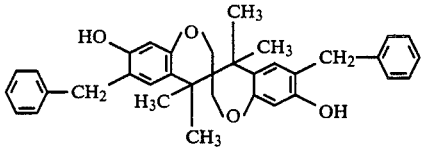
B-35
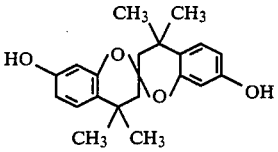
B-36
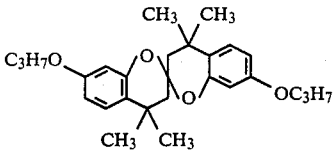
-continued
B-37
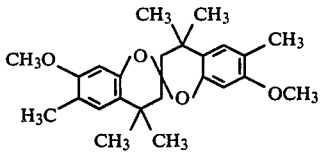
B-38
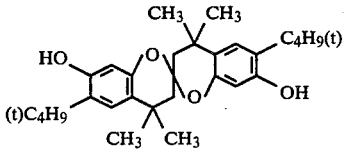
B-39
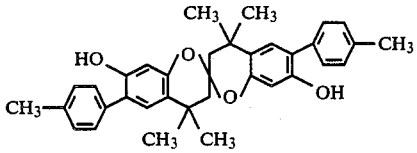
B-40
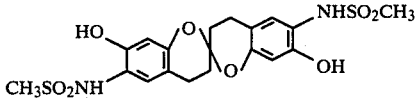
B-41
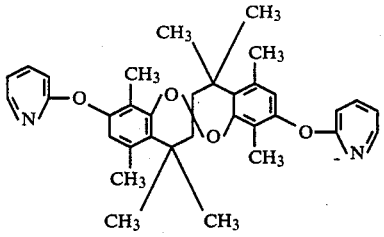
B-42
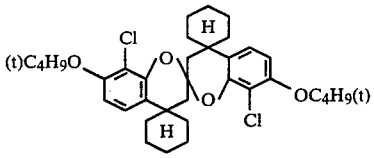
B-43
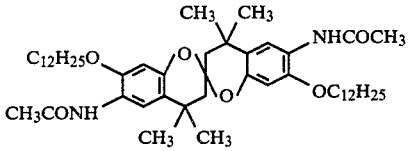
B-44
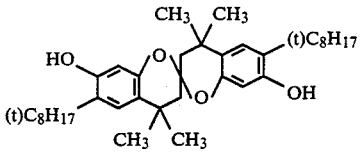
B-45
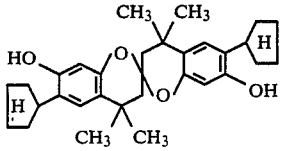
B-46
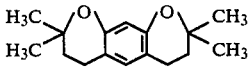

-continued

B-47

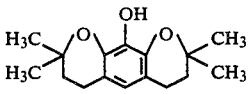

B-48

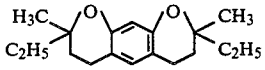

B-49

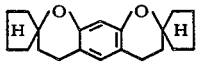

B-50

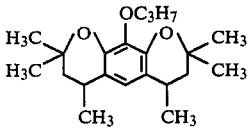

B-51

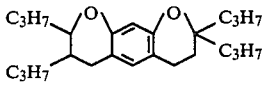

B-52

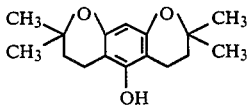

B-53

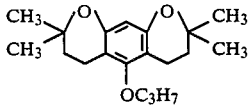

B-54

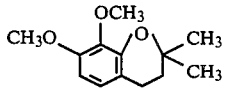

B-55

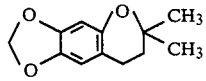

B-56

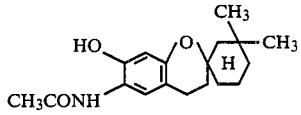

B-57

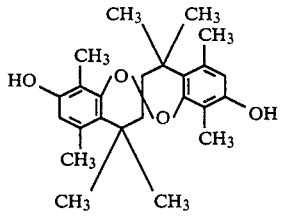

The magenta dye image stabilizers of the present invention include the compounds described in "Teraherdron" 1970, Vol. 26, pages 4743 to 4751, Journal of the Sapan Chemical Society, 1972, No. 10, pages 1987 to 1990, Chem. Lett., 1972(4), pages 315 and 316, and Unexamined Published Japanese Patent Application No. 13983/1980, and may be synthesized in accordance with the methods described therein.

The magenta dye image stabilizer represented by formula (XI) of the present invention is used in an amount of preferably 5 to 300 mol%, more preferably 10 to 200 mol%, per mole of the magenta coupler of the present invention.

The magenta dye image stabilizer of formula (XI) may be used in combination with another magenta dy image stabilizer that is represented by the following formula (XVII), namely a phenolic or phenylether compound:

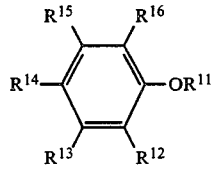

(XVII)

wherein $R^{11}$ is a hydrogen atom, an alkyl group, an alkenyl group, an aryl group or a heterocyclic group; $R^{12}$, $R^{13}$, $R^{15}$ and $R^{16}$ are each a hydrogen atom, a halogen atom, a hydroxy group, an alkyl group, an alkenyl group, an aryl group, an alkoxy group or an acylamino group; $R^{14}$ is an alkyl group, a hydroxyl group, an aryl group or an alkoxy group; $R^{11}$ and $R^{12}$ may be fused to form a 5- or 6-membered ring when $R^{14}$ represents a hydroxy or alkoxy group; $R^{11}$ and $R^{12}$ may be fused to form a methylenedioxy ring; and $R^{13}$ and $R^{14}$ may be fused to form a 5-membered hydrocarbon ring when $R^{11}$ represents an alkyl, aryl or heterocyclic group. Provided, however, that cases are excluded where $R^{11}$ is a hydrogen atom and where $R^{14}$ is a hydroxy group.

Examples of the alkyl group represented by $R^{11}$ in formula (XVII) include straight or branched chain alkyl groups methyl, such as ethyl, propyl, n-octyl, tert-octyl, benzyl and hexadecyl groups. This alkyl group may have a substituent. Examples of the alkenyl group represented by $R^{11}$ include allyl hexenyl and octenyl groups. Examples of the aryl group represented by $R^{11}$ include phenyl and naphthyl groups. This aryl group may have a substituent, and examples thereof include methoxyphenyl and chlorophenyl groups. Examples of the heterocyclic group represented by $R^{11}$ include tetrahydropyranyl and pyrimidyl groups.

Examples of the alkyl, alkenyl and aryl groups represented by $R^{12}$, $R^{13}$, $R^{15}$ and $R^{16}$ in formula (XVII) are the same as those mentioned for $R^{11}$. Examples of the halogen atom represented by $R^{12}$, $R^{13}$, $R^{15}$ and $R^{16}$ include fluorine, chlorine and bromine. Examples of the alkoxy group represented by $R^{12}$, $R^{13}$, $R^{15}$ and $R^{16}$ include methoxy, ethoxy and benzyloxy groups. The acylamino group represented by $R^{12}$, $R^{13}$, $R^{15}$ and $R^{16}$ is $R^{1}NHCO$- wherein $R^{1}$ represents an alkyl group (e.g. methyl, ethyl, n-propyl, n-butyl, n-octyl, tert-octyl and benzyl groups), an alkenyl group (e.g. allyl, octynyl and oleyl groups), an aryl group (e.g. phenyl, methoxyphenyl and naphthyl groups) or a heterocyclic group (e.g. pyridyl and pyrimidyl groups).

Examples of the alkyl and aryl groups represented by $R^{14}$ in formula (XVII) are the same as those of the alkyl and aryl groups represented by $R^{11}$. Examples of the alkoxy group represented by $R^{14}$ are the same as those of the alkoxy group mentioned with respect to $R^{12}$, $R^{13}$, $R^{15}$ and $R^{16}$.

Particularly preferred phenol or phenylether compounds among those represented by formula (XVII) that can be used in combination with the pyrazolo triazol type magenta coupler of the present invention are tetraalkoxy b; indane compounds which can be represented by the following formula (XVIII):

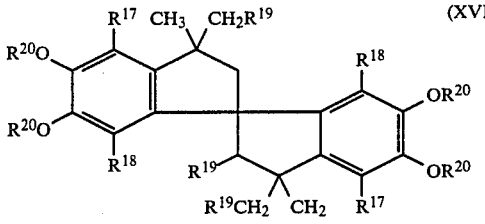

(XVIII)

wherein $R^{20}$ represents an alkyl group (e.g., methyl, ethyl, propyl, n-octyl, tert-octyl, benzyl and hexadecyl), an alkenyl group (e.g. allyl, octenyl and oleyl), an aryl group (e.g. phenyl and naphthyl) or a heterocyclic group (e.g. tetrahydropyranyl and pyrimidyl);

$R^{17}$ and $R^{18}$ each represents a hydrogen atom, a halogen atom (e.g. fluorine, chlorine and bromine), an alkyl group (e.g., methyl, ethyl, n-butyl and benzyl), an alkenyl group (e.g. allyl, hexenyl and octenyl) or an alkoxy group (e.g. methoxy, ethoxy and benzyloxy); and $R^{19}$ represents a hydrogen atom, an alkyl group (e.g. methyl, ethyl, n-butyl and benzyl), an alkenyl group (e.g. 2-propenyl, hexenyl and octenyl) or an aryl group (e.g. phenyl, methoxyphenyl, chlorophenyl and naphthyl).

Several of the compounds of formula (XVII) are described in U.S. Pat. Nos. 3,935,016, 3,982,944, and 4,254,216; Unexamined Published Japanese Patent Application Nos. 21004/1980 and 145530/1979; Published British Patent Application Nos. 2,077,455 and 2,062,888; U.S. Pat. Nos. 3,764,337, 3,432,300, 3,574,627 and 3,573,050; Unexamined Published Japanese Patent Application Nos. 152225/1977, 20327/1978, 17729/1978 and 6321/1980; British Pat. No. 1,347,556; Published British Patent Application No. 2,066,975; Japanese Patent Publication Nos. 12337/1979 and 31625/1973; and U.S. Pat. No. 3,700,455.

Specific, but by no menas limiting, examples of the compounds of formula (XVII) are listed below.

PH-1

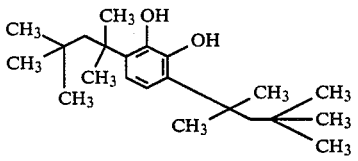

PH-2

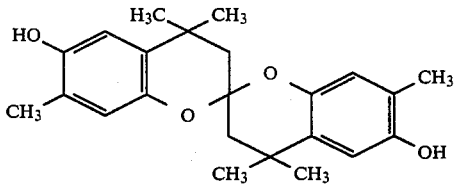

PH-3

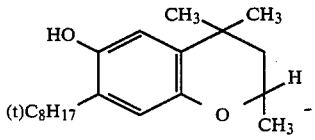

PH-4

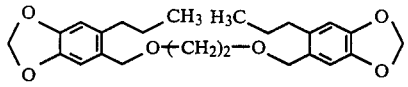

-continued

PH-5

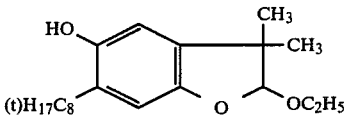

PH-6

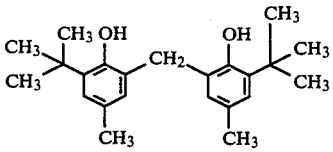

PH-7

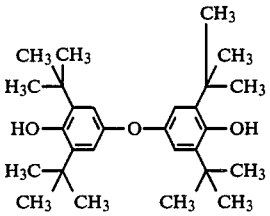

PH-8

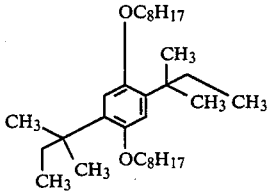

PH-9

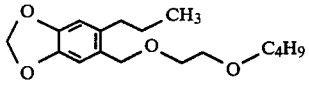

PH-10

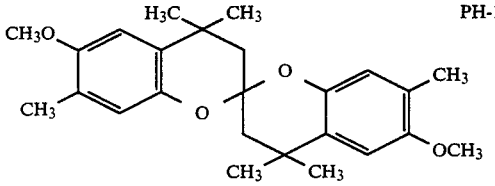

PH-11

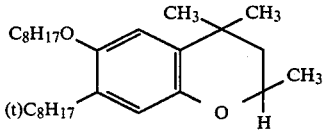

PH-12

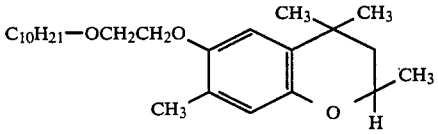

PH-13

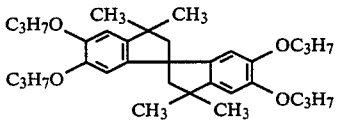

PH-14

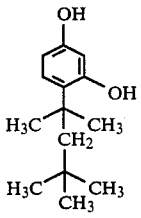

-continued

PH-15

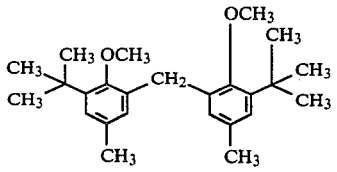

PH-16

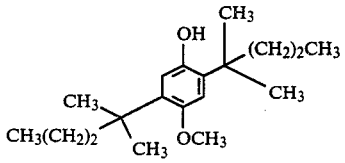

PH-17

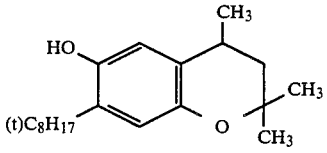

PH-18

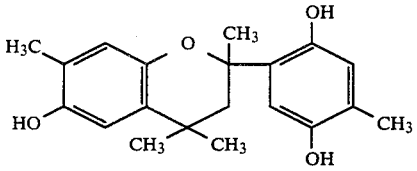

PH-19

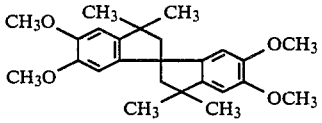

PH-20

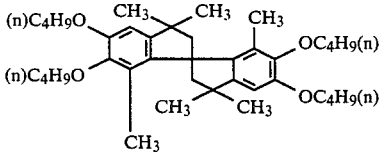

PH-21

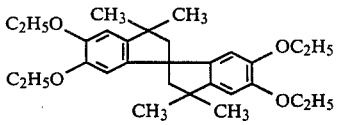

PH-22

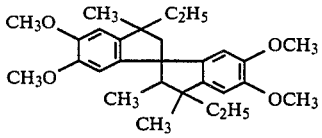

PH-23

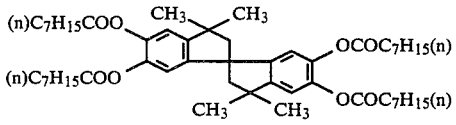

PH-24

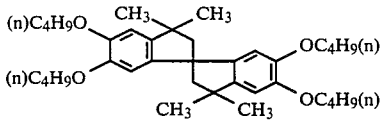

-continued

PH-25

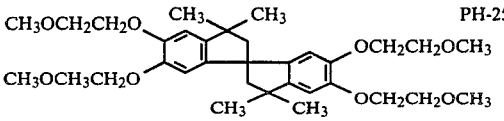

PH-26

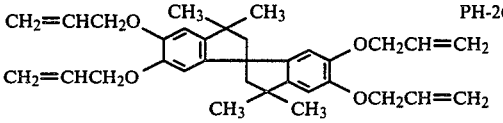

PH-27

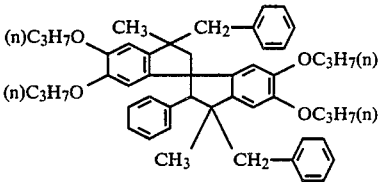

PH-28

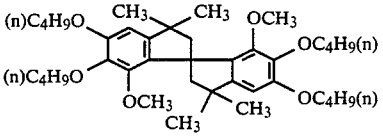

PH-29

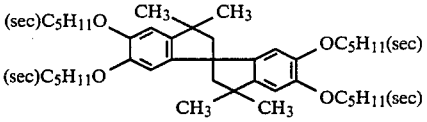

PH-30

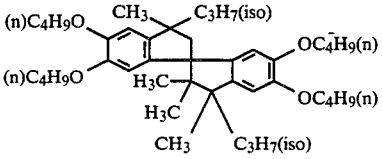

PH-31

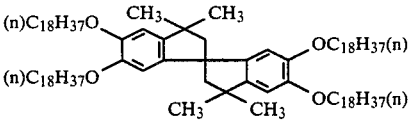

PH-32

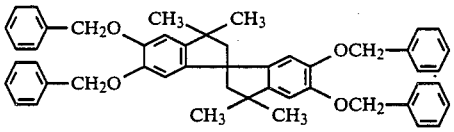

The phenolic or phenylether compound of formula (XVII) is preferably used in an amount not more than 200 mole% of the magenta dye image stabilizer of formula (XI), with the amount not exceeding 140 mole% being more preferred.

The phenolic compound and phenylether compound of formula (XVII) are effective in preventing the fading of the magenta dye image produced from the magenta coupler of the present invention, but they are little effective in preventing such magenta dye image from becoming discolored. Therefore, it is not preferred that the phenolic or phenylether compound is used in an excess amount with respect to the magenta dye image stabilizer of formula (XI).

The magenta dye image formed from the magenta coupler of the present invention generally undergoes considerable fading upon exposure to light. Furthermore, discoloration resulting from exposure to light is so great that the color of the image changes from the pure magenta to yellowish magenta. The magenta dye image stabilizer of formula (XI) is capable of exhibiting the effects unattainable by the phenolic or phenylether compound, i.e., prevention of fading and discoloration of the magenta dye image produced from the magenta coupler used in the present invention.

Accordingly, when the magenta dye image stabilizer of formula (XI) is used in admixture with the conventional magenta dye (image stabilizer, i.e., phenolic or phenylether compound, said conventional stabilizer must be used in such an amount that the discoloration upon exposure to light is not remarkable.

When such conventional stabilizer, i.e., phenolic or phenylether compound, of formula (XVII) is used in a suitable amount in combination with the magenta dye image stabilizer of formula (XI), a synergistic effect is sometimes observed which is due probably to their compensating for the mutual defective points each other.

The magenta coupler and magenta dye image stabilizer in accordance with the present invention are preferably used in the same photographic layer, but if desired, they may be incorporated in two different layers such that the stabilizer in a layer adjacent the one containing the magenta coupler.

The silver halide photographic material of the present invention may be, for example, color negative and positive films and color photographic paper, but particularly when color photographic paper for viewing the printed color image directly is used, the effect of the present invention is produced strikingly.

The silver halide photographic material of the present invention including such color photographic paper may be either for monochrome or multicolor use. The silver halide photographic material for multicolor use has a structure such that silver halide emulsion layers usually containing magenta, yellow and cyan couplers, respectively, as photographic couplers, and nonsensitive layers are superimporsed in appropriate number of layers and in appropriate sequence on the support in order to effect subtractive color reproduction, but such number of layers and sequence may be changed appropriately according to use object.

The silver halide emulsion used in the silver halide photographic material of the present invention may be selected from among the silver halides commonly used in silver halide photography, such as silver bromide, silver chloride, silver iodobromide, silver chlorobromide and silver chloroiodobromide.

The silver halide grains used in the silver halide emulsions of the present invention may be those obtained by any of the acid method, neutral method, and ammoniacal method. These grains may be grown at one time or may be grown after preparing seed grains. The method of preparing seed grains and the method of growing them may be the same or different.

In preparing the silver halide emulsion, halide ions and silver ions may admixed at the same time, or either one may be admixed with the other one present in the emulsion. Also, while considering the critical speed of growth of silver halide crystals, halide ions and silver ions may be added one by one or at the same time into a mixing bath while controlling the pH and pAg in said bath to grow the crystals.

In preparing the silver halide of the present invention, it is possible, by using a silver halide solvent optionally, to control the grain size, shape, grain size distribution and speed of growth of the silver halide grains.

The silver halide grains to be used in the silver halide emulsions of the present invention may have metal ions incorporated inside the grains and/or in the grain surfaces in the course of forming and/or growing the grains by using cadmium salt, zinc salt, lead salt, thallium salt, iridium salt or its complex salt, rhodium salt or its complex salt, or iron salt or its complex salt. Said grains may also be placed in an appropriate reduction atmosphere to have reduction-sensitized specks imparted inside the grains and/or into the grain surfaces.

The silver halide emulsions of the present invention may be removed of unnecessary soluble salts after completion of the growth of the silver halide grains or may be left as they are containing such salts. In removing said salts; the method described in "Research Disclosure No. 17643" may be used.

The silver halide grains to be used in the silver halide emulsions of the present invention may have a homogeneous structure throughtoug the crystal, or the structure of the core may be different from that of the shell. These silver halide grains may be of the surface type where latent images are predominantly formed on the grain surface or of the internal type where latent images are formed within the grain.

The silver halide grains may be regular crystals or irregular crystals such as inspherical or plane form. They may have any proportions of (100) and (111) planes, and may also be in composite form of these crystals or may be admixed with various crystal grains.

The silver halide emulion of the present invention may be a mixture of two or more silver halide emulsions prepared separately.

The silver halide emulsion of the present invention is chemically sensitized by an ordinary method, such as the sulfur sensitization using a compound containing sulfur capable of reaction with silver ions or using active gelatin, the selenium sensitization using a selenium compound, the reduction sensitization using reducible material, or the noble metal sensitization using gold and other noble metal compounds. Such methods may be used each independently or in combination.

The silver halide emulsion of the present invention may be spectrally sensitized by suitably selected sensitizing dye in order to provide sensitivity for the desired spectral wavelength regions. A variety of spectral sensitizing dyes may be used either individually or in combination. The silver halide emulsion may contain, together with the sensitizer, a dye which itself has no spectral sensitizing action or a supersensitizer which, being a compound which substantially does not absorb visible light, strengthens the sensitizing action of the sensitizer.

In order to prevent the occurrence of fog and/or keep the photographic properties stable, in the course of preparing the photographic material, in storage or in processing thereof, a compound known in the photographic industry as an anti-foggant or stabilizer may be added to the silver halide emulsion of the present invention in the course of chemical ripening and/or upon completion of chemical ripening and/or after completion of chemical ripening but before coating of the silver halide emulsion.

The binder (or protective colloid) advantageously used in the silver halide emulsion of the present invention is gelatin, but other hydrophilic colloids such as gelatin derivative, glaft polymer of gelatin with other polymer, protein, sugar derivative, cellulose derivative, and synthesized by hydrophillic polymer may be used.

The photographic emulsion layer and other hydrophilic colloidal layer(s) of the photographic material using the silver halide emulsion of the present invention are hardened by using hardeners either alone or in combination that bridge the binder (or protective colloid) molecules to enhance the film strength. The hardener is desirably added in such an amount as is capable of hardening the photographic material to the extent that there is no need to add the hardener in the processing solution, but such hardener may be added in the processing solution.

A plasticizer can be added with a view to enhancing the flexibility of the silver halide emulsion layer and/or other hydrophilic colloidal layer(s) of the photographic material using the silver halide emulsion of the present invention.

A water-insoluble or hardly soluble synthesized polymer latex can be incorporated for the purpose of improving the dimentional stability of the photographic emulsion layer and other hydrophilic colloidal layer(s) of the photographic material using the silver halide emulsion of the present invention.

In the emulsion layer of the silver halide color photographic material of the present invention, a dye-forming coupler is used which forms a dye upon coupling reaction with the oxidized product of an aromatic primary amine developing agent (e.g., p-phenylenediamine derivative or aminophenol derivative) in the color developing processing. The color-forming coupler is usually selected so that a dye is formed which absorbs the spectral wavelength sensitive to the emulsion layer containing said dye; that is, a yellow dye-forming coupler is used in the blue-sensitive emulsion layer, a magenta dye-forming coupler in the green-sensitive emulsion layer, and a cyan dye-forming coupler in the red-sensitive emulsion layer. However, the respective couplers may be used in different combinations from those mentioned above according to the object.

The yellow dye-forming coupler includes acylacetamido couplers (e.g. benzoylacetanilides and pivaloyl acetanilides), the magneta dye-forming coupler includes, in addition to the couplers of the present invention, 5-pyrazolone, pyrazolobenzimidazole, pyrazolotriazole and open chained acylacetonitrile couplers, and the cyan dye-forming coupler includes naphthol and phenol couplers.

These dye-forming couplers desirably have a group having 8 or more carbon atoms in the molecule that, being called a ballast group, renders the coupler non-diffusible. These couplers may be 4-equivalent couplers such that four silver ions need be reduced for the formation of one mole of dye, or may be 2-equivalent couplers such that only two silver ions suffice to be reduced for the formation of one mole of dye.

Hydrophobic compounds such as dye-forming coupler that need not be adsorpted onto the silver halide crystal surfaces can be dispersed into the emulsion by means of solid dispersion, latex dispersion or oil-in-water drop type emulsion dispersion. Such dispersion method can be appropriately selected according to the chemical structure and the like of the hydrophobic compounds. The oil-in-water drop type emulsion dispersion method may be any conventional method of dispersing hydrophobic additives such as coupler, which usually comprises dissolving such hydrophobic additives in a high-boiling organic solvent having a boiling point higher than about 150° C. by optionally using low-boiling and/or water-soluble organic solvents together, then emulsion-dispersing the dissolved hydrophobic additives by using a surfactant in a hydrophilic binder such as aqueous gelatin solution with such means of dispersion as a stirrer, homogenizer, colloid mill, flow-jet mixer or ultrasonic disperser, and thereafter adding the resulting dispersion into the hydrophilic colloidal layer. In that case, the step of removing the low-boiling organic solvent after or simultaneously with dispersion may be added.

The high-boiling organic solvent is one having a boiling point higher than 150° C. that does not react with the oxidized product of a developing agent, such as a phenol derivative, phthalate ester, phosphate ester, citrate ester, benzoate ester, alkylamido, fatty acid ester or trimesic acid ester.

Dispersion aids used in dissolving hydrophobic compounds in a low-boiling solvent alone or mixed with a high-boiling solvent and dispersing the dissolved hydrophobic compounds into water by using a mixer or ultrasonic disperser include anionic surfactants, nonionic surfactants and cationic surfactants.

Anti-color foggants may be used in order to prevent occurrence of color stain, deterioration of sharpness and coarse graininess due to moving of the oxidized product of a developing agent or the electron transporting agent between the emulsion layers (the same color-sensitive layers and/or different color-sensitive layers) of the color photographic material of the present invention.

The anti-color foggants may be incorporated in the emulsion layer itself or in the intermediate layer provided between adjacent emulsion layers.

Image stabilizers can be incorporated in the color photographic material using silver halide emulsion layers of the present invention in order to prevent deterioration of color images.

The hydrophilic colloidal layers such as protective layer and intermediate layer of the photographic material of the present invention may have incorporated therein UV absorbers in order to prevent occurrence of fogging due to discharge resulting from the photographic material being charged by its friction or the like, or to prevent deterioration of images due to UV light.

The color photographic material using a silver halide emulsion of the present invention can be provided with auxiliary layers such as filter layer, anti-halation layer and/or anti-irradiation layer. These auxiliary layers and/or the emulsion layers may have incorporated therein dyes flowing out of the color photographic material or being bleached during the color developing processing.

Matting agents can be incorporated in the silver halide emulsion layers and/or other hydrophilic colloidal layers of the silver halide photographic material using a silver halide emulsion of the present invention, with a view to reducing the surface gloss to render writing in pencil possible and to preventing adhesion of photographic materials to each other.

The light-sensitive material using the silver halide emulsion of the present invention may contain a lubricant that is capable of reducing its sliding friction.

The light-sensitive material may also contain an antistat for the purpose of preventing static buildup. The antistat may be incorporated in an antistatic layer on the side of the support where no emulsion layer is formed.

Alternatively, the antistat may be incorporated in an emulsion layer and/or a protective layer other than an emulsion layer which is on the side of the support where said emulsion layer is formed.

Photographic emulsion layers and/or other hydrophilic colloidal layers in the light-sensitive material using the silver halide emulsion of the present invention may contain a variety of surfactants for attaining such purposes as improved coating property, prevention of antistatic buildup, improved slipping property, emulsification/dispersion, antiblocking and improved photographic characteristics in terms of accelerated development, hard tone and sensitization.

Photographic emulsion layers and other layers for making a light-sensitive material using the silver halide emulsion of the present invention may be coated onto flexible reflecting supports such as paper or synthetic paper laminated with baryta layer or $\alpha$-olefin polymer, films made of semi-synthetic or synthetic polymers such as cellulose acetate, cellulose nitrate, polystyrene, polyvinyl chloride, polyethylene terephthalate, polycarbonate and polyamide, and rigid materials such as glass, metals and ceramics.

After optional surface treatment of the support by suitable techniques such as corona discharge, UV irradiation and flame treatment, the silver halide light-sensitive material of the present invention may be coated onto the support either directly or with one or more subbing layers formed thereon. The subbing layers are provided for improving the adhesive strength, antistatic property, dimensional stability, frictional resistance, hardness, anti-halation property, frictional characteristics and/or other characteristics of the surface of the support.

A thickener may be used in order to facilitate the coating of the photographic material using the silver halide emulsion of the present invention. Particularly useful coating techniques are extrusion coating and curtain coating, both of which will enable simultaneous application of two or more layers.

The light-sensitive material of the present invention may be exposed to electromagnetic waves in the spectral region to which the emulsion layers that make up the light-sensitive material have sensitivity. Any known light sources may be used and they include daylight (sunshine), tungsten lamps, fluorescent lamps, mercury lamps, xenon arc lamps, carbon arc lamps, xenon flash lamps, CRT flying spot, light from a variety of lasers, LED emitted light, and light emitted from fluorescent materials upon excitation by electron beams, X-rays, gamma-rays or alpha-rays.

The exposure time may range from 1 millisecond to 1 second as is usually the case with cameras. Periods shorter than 1 microsecond, such as one ranging from 100 microseconds to 1 microsecond may be employed with CRTs or xenon flash lampls. Exposure longer than 1 second would also be possible. The exposure may be continuous or intermittent.

The silver halide photographic material of the present invention may form an image by any techniques of color development that are known in the art. The color developer used to process this photographic material may contain any of the known aromatic primary amine color developing agents that are extensively used in various color photographic processes. Such developing agents include aminophenolic and p-phenylenediamine derivatives. These compounds are generally used in salt forms, such as hydrochlorides or sulfates, which are stabler than the free state. These compounds are used in concentrations that generally range from about 0.1 to about 30 g, preferably from about 1 g to about 1.5 g per liter of the color developer.

Illustrative aminophenolic developing agents include o-aminophenol, p-aminophenol, 5-amino-2-oxytoluene, 2-amino-3-oxytoluene, and 2-oxy-3-amino-1,4-dimethylbenzene.

Particularly useful primary aromatic amino color developing agents are N,N-dialkyl-p-phenylenediamine compounds wherein the alkyl or phenyl group may have a suitable substituent. Among these compounds, the following are particularly advantageous: N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethylaniline, and 4-amino-N-(2-methoxyethyl)-N-ethyl-3-methylaniline-p-toluene sulfonate.

In addition to these primary aromatic amino color developing agents, the color developer used in the processing of the photographic material of the present invention may contain a variety of additives that are commonly incorporated in color developers and such additives include alkali agents (e.g. sodium hydroxide, sodium carbonate and potassium carbonate), alkali metal sulfites, alkali metal bisulfites, alkali metal thiocyanates, alkali metal halides, benzyl alcohol, water softeners and thickeners. The pH of the color developer is usually at least 7 and most generally ranges from about 10 to about 13.

After color development, the photographic material of the present invention is processed by a solution having the fixing ability. If this solution is a fixing bath, its use is preceded by a bleaching step. The bleaching agent used in the bleaching bath is a metal complex salt of an organic acid. This metal complex salt has the ability not only to oxidize metallic silver (i.e., formed as a result of development) into silver halide but also to ensure complete color formation by a color former. The structure of this metal complex salt is such that an organic acid such as an aminopolycarboxylic acid, oxalic acid or citric acid is coordinated to a metal ion such as iron, cobalt or copper. The organic acids most preferred for use in forming metal complex salts are polycarboxylic acids or aminopolycarboxylic acids. The polycarboxylic acids or aminopolycarboxylic acids may be in the form of alkali metal salts, ammonium salts or water-soluble amine salts.

Typical examples of polycarboxylic acids or aminopolycarboxylic acids are lited below:

(1) ethylenediaminetetraacetic acid;
(2) nitrilotriacetic acid;
(3) iminodiacetic acid;
(4) ethylenediaminetetraacetic acid disodium salt;
(5) ethylenediaminetetraacetic acid tetra(trimethylammonium)salt;
(6) ethylenediaminetetraacetic acid tetrasodium salt; and
(7) nitrilotriacetic acid sodium salt.

In addition to metal complex salts of these organic acids which are used as bleaching agents, the bleaching bath used in processing the color photographic material of the present invention may contain a variety of additives, and preferred additives are rehalogenating agents such as alkali or ammonium halides (e.g., potassium bromide, sodium bromide, sodium chloride and ammonium bromide), metal salts and chelating agents. Any other additives that are conventionally incorporated in bleaching baths may also be used and they include pH buffers (e.g., borate, oxalate, acetate, carbonate and phosphate salts), alkylamines and polyethylene oxides.

The fixing bath and bleach-fixing bath may also contain one or more pH buffers that are selected from among sulfites (e.g., ammonium sulfite, potassium sulfite, ammonium bisulfite, potassium bisulfite, sodium bisulfite, ammonium metabisulfite, potassium metabisulfite, and sodium metabisulfite), and a variety of acids or salts (e.g., boric acid, borax, sodium hydroxide, potassium hydroxide, sodium carbonate, potassium carbonate, sodium bicarbonate, sodium bisulfite, potassium bicarbonate, acetic acid, sodium acetate and ammonium hydroxide).

If the photographic material of the present invention is processed in a bleach-fixing bath as it is supplied with a blix replenisher, thiosulfates, thiocyanates, sulfites or other salts may be incorporated either in the bleach-fixing bath or in the replenisher that is fed to said blix bath.

In order to increase the activity of the bleach-fixing bath used in processing the photographic material of the present invention, air or oxygen may be blown into a tank containing the bleach-fixing bath or its replenisher. Alternatively, a suitable oxidant such as hydrogen peroxide, bromate or persulfate may be added into the tank.

ADVANTAGES OF THE INVENTION

Color photographic materials containing the magenta coupler of the present invention and a magenta dye image stabilizer represented by formula (XI) are improved in the fastness of magenta dye images particularly against light, heat and humidity; that is, the discoloration and fading of color against light as well as the occurrence of yellow stain in the background due to light, heat and humidity are satisfactorily prevented.

The magenta coupler of the present invention, when used in combination with a dye image stabilizer of formula (XVII), renders it possible to improve the fastness of magenta dye images against light greatly.

The advantages of the present invention are hereunder described in greater detail by reference to working examples which are given here for illustrative purposes only and are by no means intended as limiting the invention.

EXAMPLE 1

Gelatin (15.0 mg/100 $cm^2$) and comparative magenta coupler (A) (6.0 mg/100 $cm^2$) were dissolved and dispersed in tricresyl phosphate together with 2,5-di-tert-octylhydroquinone (0.8 mg/100 $cm^2$). The dispersion was mixed with a silver chlorobromide emulsion (containing 80 mol% of silver bromide) and the mixture was coated onto a paper support laminated with polyethylene on both surfaces, so as to provide a silver deposit of 3.8 mg/100 $cm^2$. The so formed emulsion layer was dried to prepare sample No. 1.

To sample No. 1, a conventional magenta dye image stabilizer (PH-13) was added in an amount equimolar to that of the magenta coupler, thereby preparing sample No. 2.

Sample Nos. 3, 7 and 11 were prepared as in the case of sample No. 1 except that comparative magenta coupler (A) was replaced by 1, 5 and 100, three of the triazole type magenta couplers defined in the present invention.

Sample Nos. 4, 8 and 12 were prepared by modifying sample Nos. 3, 7 and 11 with PH-13 added in an amount equimolar to that of the magenta coupler. Sample Nos. 5, 9 and 13 were prepared by modifying sample Nos. 3, 7 and 11 with B-35, a magenta dye image stabilizer within the scope of the invention, added in an amount equimolar to that of the magenta coupler. Sample Nos. 6, 10 and 14 were prepared by modifying sample Nos. 3, 7 and 11 with PH-13, and B-35 added at a ratio of 1:1 and in a total amount equimolar to that of the magenta coupler.

Comparative magenta coupler (A)

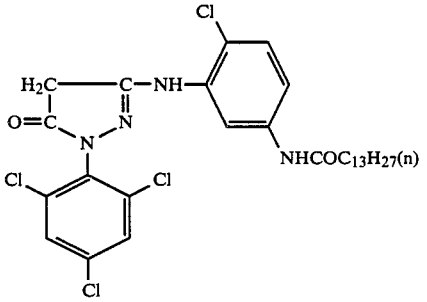

Each of the samples thus prepared was exposed through an optical wedge by the conventional method and subsequently processed by the following scheme.

| Steps | Temperature, °C. | Time |
|---|---|---|
| Color development | 33 | 3 min and 30 sec |
| Bleach-fixing | 33 | 1 min and 30 sec |
| Washing | 33 | 3 min |
| Drying | 50–80 | 2 min |

The processing solutions used had the following compositions.

| | |
|---|---|
| Color developer: | |
| Benzyl alcohol | 12 ml |
| Diethylene glycol | 10 ml |
| Potassium carbonate | 25 g |
| Sodium bromide | 0.6 g |
| Anhydrous sodium sulfite | 2.0 g |
| Hydroxylamine sulfate | 2.5 g |
| N—ethyl-N—β-methanesulfonamidoethyl-3-methyl-4-aminoaniline sulfate | 4.5 g |
| Water to make | 1,000 ml |
| pH adjusted to 10.2 with NaOH. | |
| Bleach-fixing bath: | |
| Ammonium thiosulfate | 120 g |
| Sodium metabisulfite | 15 g |
| Anhydrous sodium sulfite | 3 g |
| EDTA iron (III) ammonium salt | 65 g |
| Water to make | 1,000 ml |
| pH adjusted to 6.7–6.8. | |

Each of the processed samples was placed under illumination in a xenon fadeometer for 8 days so as to examine the light fastness of the dye image and Y staining in the background. Another set of the processed samples were left for 14 days in a hot and humid atmosphere (60° C.×80% RH) so as to examine the resistance of the dye image to moisture and Y staining in the background. The results are shown in Table 1.

The light fastness and moisture resistance of each sample were evaluated on the following bases.

Residual dye

The density of the dye remaining after each of the tests on light fastness and moisture resistance was indicated as a percentage of the initial density (1.0).

YS

The density of Y stain before each test was subtracted from the value after testing.

Discoloration

The ratio of yellow density to magenta density as measured before testing for an initial density of 1.0 was subtracted from the value after testing. The greater the value obtained, the greater the discoloration from the pure magenta to a yellowish magenta color.

TABLE 1

| Sample No. | Coupler | Dye image stabilizer | Light fastness Residual dye (%) | Light fastness YS | Light fastness Discoloration | Moisture resistance Residual dye (%) | Moisture resistance YS |
|---|---|---|---|---|---|---|---|
| 1 (Comparative) | A | — | 50% | 0.54 | 0.31 | 88% | 0.53 |
| 2 " | " | PH-13 | 79 | 0.51 | 0.27 | 89 | 0.56 |
| 3 " | 1 | — | 21 | 0.04 | 0.80 | 101 | 0.06 |
| 4 " | " | PH-13 | 70 | 0.10 | 0.79 | 103 | 0.06 |
| 5 (Sample of the invention) | " | B-35 | 78 | 0.05 | 0.18 | 104 | 0.07 |
| 6 (Sample of the invention) | " | B-35 PH-13 | 83 | 0.06 | 0.19 | 100 | 0.07 |
| 7 (Comparative) | " | — | 19 | 0.05 | 0.87 | 102 | 0.08 |
| 8 " | " | PH-13 | 69 | 0.12 | 0.81 | 100 | 0.07 |
| 9 (Sample of the invention) | " | B-35 | 76 | 0.05 | 0.16 | 99 | 0.06 |
| 10 (Sample of the invention) | " | B-35 PH-13 | 80 | 0.06 | 0.18 | 101 | 0.07 |
| 11 (Comparative) | 100 | — | 14 | 0.05 | 0.79 | 98 | 0.07 |
| 12 " | " | PH-13 | 65 | 0.17 | 0.72 | 100 | 0.09 |
| 13 (Sample of the invention) | " | B-35 | 68 | 0.11 | 0.11 | 102 | 0.08 |
| 14 (Sample of the invention) | " | B-35 PH-13 | 75 | 0.09 | 0.13 | 100 | 0.08 |

As is clear from Table 1, Sample Nos. 3, 7 and 11, using the magenta couplers within the scope of the invention, were found through fastness to light and moisture tests to be highly resistant to Y staining as compared with sample No. 1 using the conventional four-equivalent 3-anilino-1,2-pyrazolo-5-one coupler. However, the results of the light fastness test with respect to residual dye and discoloration show that sample Nos. 3, 7 and 11 discolored and faded quite easily upon exposure to light. Sample Nos. 4, 8 and 12 used the magenta couplers of the present invention in combination with PH-13, a conventional magenta dye image stabilizer. These samples exhibited an appreciable reduction in the fading of dye image resulting from exposure to light, but their resistance to discoloration was not improved at all.

Sample Nos. 5, 9 and 13 using magenta couplers and a magenta dye image stabilizer, both in accordance with the present invention, experienced small degrees of discoloration and fading upon exposure to light, heat and moisture, and the Y staining occurring in the background was negligible. These results were certainly unobtainable by sample No. 2 using the conventional four-equivalent 3-anilino-1,2-pyrazolo-5-one magenta coupler and PH-13 (conventional magenta dye image stabilizer).

Sample Nos. 6, 10 and 14 using the magenta coupler and magenta dye image stabilizer of the present invention in combination with a conventional magenta dye image stabilizer were found to be greatly improved in residual dye percentage in the light fastness test.

EXAMPLE 2

Sample Nos. 15–30 were prepared as in Example 1 except that the combinations of magenta coupler and magenta dye image stabilizer were changed to those indicated in Table 2. These samples were processed as in Example 1 and subsequently tested for their light-fastness and moisture resistance as in Example 1. The results are shown in Table 2.

The comparative magenta coupler B in Table 2 has the following structure:

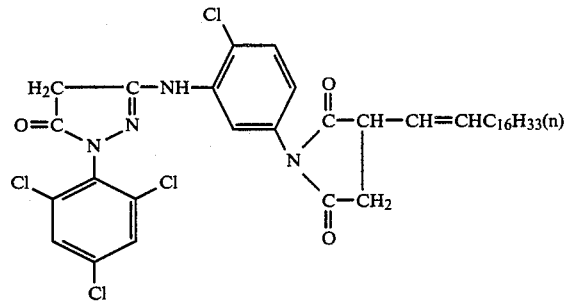

TABLE 2

| Sample No. | Coupler | Dye image stabilizer | Light fastness Residual dye (%) | Light fastness YS | Light fastness Discoloration | Moisture resistance Residual dye (%) | Moisture resistance YS |
|---|---|---|---|---|---|---|---|
| 15 (Comparative) | B | B-1 | 49% | 0.59 | 0.37 | 88% | 0.52 |
| 16 " | " | B-36 | 48 | 0.55 | 0.35 | 87 | 0.60 |
| 17 " | " | PH-8 | 72 | 0.53 | 0.26 | 88 | 0.57 |
| 18 " | " | PH-10 | 73 | 0.54 | 0.28 | 86 | 0.52 |

TABLE 2-continued

| Sample No. | Coupler | Dye image stabilizer | Light fastness Residual dye (%) | YS | Discoloration | Moisture resistance Residual dye (%) | YS |
|---|---|---|---|---|---|---|---|
| 19 " | 127 | PH-8 | 62 | 0.13 | 0.88 | 100 | 0.08 |
| 20 " | " | PH-10 | 63 | 0.16 | 0.84 | 102 | 0.08 |
| 21 " | 35 | PH-8 | 68 | 0.16 | 0.80 | 99 | 0.10 |
| 22 " | " | PH-10 | 67 | 0.16 | 0.76 | 98 | 0.10 |
| 23 (Sample of the invention) | 127 | B-1 | 63 | 0.04 | 0.12 | 102 | 0.08 |
| 24 (Sample of the invention) | " | B-36 | 65 | 0.05 | 0.12 | 102 | 0.10 |
| 25 (Sample of the invention) | 35 | B-1 | 73 | 0.04 | 0.13 | 103 | 0.13 |
| 26 (Sample of the invention) | " | B-36 | 74 | 0.04 | 0.11 | 100 | 0.09 |
| 27 (Sample of the invention) | " | B-15 | 76 | 0.04 | 0.09 | 100 | 0.09 |
| 28 (Sample of the invention) | " | B-26 | 73 | 0.05 | 0.14 | 104 | 0.09 |
| 29 (Sample of the invention) | " | B-37 | 78 | 0.05 | 0.13 | 103 | 0.07 |
| 30 (Sample of the invention) | " | B-46 | 72 | 0.05 | 0.12 | 99 | 0.11 |

As Table 2 clearly shows, sample Nos. 15 and 16 using the conventional four-equivalent 3-anilino-1,2-pyrazolo-5-one coupler in combination with magenta dye image stabilizers within the scope of the invention, and sample Nos. 19, 20, 21 and 22 using the combination of magenta couplers falling within the scope of the invention and commonly employed magenta dye image stabilizers were unable to give satisfactory results in all aspects of the light-fastness test and moisture resistance test. The intended results were obtained only when the magenta couplers within the scope of the invention were combined with magenta dye image stabilizers within the scope of the invention.

EXAMPLE 3

A paper support laminated with polyethylene on both sides was coated with the following photographic layers in sequence, with the first layer (blue-sensitive silver halide emulsion layer) positioned closest to the support. As a result, sample No. 3 of multi-colored silver halide photographic material was obtained.

First layer: blue-sensitive silver halide emulsion layer

This layer was formed by coating 6.8 mg/100 cm$^2$ of α-pivaloyl-(2,4-dioxo-1-benzylimidazolidin-3-yl)-2-chloro-5-[γ-(2,4-di-t-amylphenoxy)butylamido]acetanilide (yellow coupler), 3.2 mg/100 cm$^2$, in terms of silver, of a blue-sensitive silver chlorobromide emulsion (85 mol% silver bromide), 3.5 mg/100 cm$^2$ of dioctyl phthalate and 13.5 mg/100 cm$^2$ of gelatin.

Second layer: intermediate layer

This layer was formed by coating 0.5 mg/100 cm$^2$ of 2,5-di-t-octylhydroquinone, 0.5 mg/100 cm$^2$ of dinonyl phthalate and 9.0 mg/100 cm$^2$ of gelatin.

Third layer: green-sensitive silver halide emulsion layer

This layer was formed by coating 3.5 mg/100 cm$^2$ of magenta coupler 74 (a magenta coupler included in the scope of the invention), 2.5 mg/100 cm$^2$, in terms of silver, of a blue-sensitive silver chlorobromide emulsion (80 mol% silver bromide), 3.0 mg/100 cm$^2$ of dioctyl phthalate and 12.0 mg/100 cm$^2$ of gelatin.

Fourth layer: intermediate layer

This layer was formed by coating 7.0 mg/100 cm$^2$ of 2-(2-hydroxy-3-sec-butyl-5-t-butylphenyl)benzotriazole (UV absorber), 6.0 mg/100 cm$^2$ of dibutyl phthalate, 0.5 mg/100 cm$^2$ of 2,5-di-t-octylhydroquinone and 12.0 mg/100 cm$^2$ of gelatin.

Fifth layer: red-sensitive silver halide emulsion layer

This layer was formed by coating 4.2 mg/100 cm$^2$ of 2-[α-(2,4-di-t-pentylphenoxy)butanamido]-4,6-dichloro-5-ethylphenol, 3.5 mg/100 cm$^2$ of tri-2-ethylhexyl phosphate and 11.5 mg/100 cm$^2$ of gelatin.

Sixth layer: protective layer

This layer was formed by coating 8.0 mg/100 cm$^2$ of gelatin.

Sample Nos. 32 to 40 were prepared by modifying sample No. 31 with magenta dye image stabilizers of the present invention that were incorporated in the 3rd layer in the amounts indicated in Table 3. Sample Nos. 32 to 40 were processed as in Example 1 and subjected to a light-fastness test under illumination in a xenon fedeometer for 15 days. The test results are shown in Table 3.

TABLE 3

| Sample No. | | Dye image stabilizer | Amount of stabilizer (mol %/coupler) | Residual magenta dye (%) |
|---|---|---|---|---|
| | 31 (Comparative) | — | — | 17 |
| (samples of the invention) | 32 | B-6 | 50 | 45 |
| | 33 | " | 100 | 53 |
| | 34 | " | 150 | 76 |
| | 35 | B-35 | 50 | 51 |
| | 36 | " | 100 | 63 |
| | 37 | " | 150 | 81 |
| | 38 | B-46 | 50 | 46 |
| | 39 | " | 100 | 60 |
| | 40 | " | 150 | 82 |

The data in Table 3 show that the magenta dye image stabilizers in accordance with the present invention are effective in stabilizing the dye image formed by the magenta coupler of the present invention and that this effectiveness is increased as the amounts in which these stabilizers are incorporated is increased. Samples Nos. 32 to 40 experienced a very small amount of discoloration in the magenta image as a result of exposure to light. Furthermore, these samples of the present invention suffered an extremely small degree of fading in the magenta dye. Therefore, they struck a good color balance between yellow, cyan and magenta couplers and displayed a highly satisfactory color reproduction.

EXAMPLE 4

Gelatin (15.0 mg/100 $cm^2$) and magenta coupler 144 of the present invention (6.0 mg/100 $cm^2$) were dispersed in tricresylphosphate together with 2,5-di-tert-octylhydroquinone (0.8 mg/100 $cm^2$). The dispersion was mixed with a silver chlorobromide emulsion (containing 80 mol% of silver bromide) and the mixture was coated onto a paper support laminated with polyethylene on both surfaces, so as to provide a silver deposit of 3.8 mg/100 $cm^2$. The so formed emulsion layer was dried to prepare sample No. 41.

To sample No. 41, a magenta dye image stabilizer (PH-13) was added in an amount equimolar to that of the magenta coupler, thereby preparing sample No. 42.

Sample Nos. 45 and 49 were prepared as in the case of sample No. 41 except that magenta coupler 144 was replaced by 150 and 168, two of the magenta couplers defined in the present invention.

Sample Nos. 46 and 50 were prepared by modifying sample Nos. 45 and 49 with PH-13 added in an amount equimolar to that of the magenta coupler. Sample Nos. 43, 47 and 51 were prepared by modifying sample Nos. 42, 46 and 50 with B-35, a magenta dye image stabilizer within the scope of the invention, in place of PH-13, added in an amount equimolar to that of the magenta coupler.

Sample Nos. 44, 48 and 52 were prepared by modifying sample Nos. 43, 47 and 51 with PH-13 and B-35 added at a ratio of 1:2 and in a total amount equimolar to that of the magenta coupler.

Each of the samples thus prepared was exposed through an optical wedge by the conventional method and subsequently processed by the following scheme.

| Steps | Temperature, °C. | Time |
|---|---|---|
| Color development | 33 | 3 min and 30 sec |
| Bleach-fixing | 33 | 1 min and 30 sec |
| Washing | 33 | 3 min |
| Drying | 50–80 | 2 min |

The processing solutions used had the following compositions.

| | |
|---|---|
| Color developer: | |
| Benzyl alcohol | 12 ml |
| Diethylene glycol | 10 ml |
| Potassium carbonate | 25 g |
| Sodium bromide | 0.6 g |
| Anhydrous sodium sulfite | 2.0 g |
| Hydroxylamine sulfate | 2.5 g |
| N—ethyl-N—β-methanesulfonamidoethyl-3-methyl-4-aminoaniline sulfate | 4.5 g |
| Water to make | 1,000 ml |
| pH adjusted to 10.2 with NaOH. | |
| Bleach-fixing bath: | |
| Ammonium thiosulfate | 120 g |
| Sodium metabisulfite | 15 g |
| Anhydrous sodium sulfite | 3 g |
| EDTA iron (III) ammonium salt | 65 g |

-continued

| | |
|---|---|
| Water to make | 1,000 ml |
| pH adjusted to 6.7–6.8. | |

Each of the processed samples was placed under illumination in a xenon fadeometer for 12 days so as to examine the light fastness of the dye image. The results are shown in Table 4.

The light fastness of each sample was evaluated on the following bases.

Residual dye

The density of the dye remaining after each of the tests on light fastness and moisture resistance was indicated as a percentage of the initial density (1.0).

Discoloration

The ratio of yellow density to magenta density as measured before testing for an initial density of 1.0 was subtracted from the value after testing. The greater the value obtained, the greater the discoloration from the pure magenta to a yellowish magenta color.

TABLE 4

| Sample No. | Coupler | Dye image stabilizer | Moisture resistance: Residual dye (%) | Moisture resistance: YS |
|---|---|---|---|---|
| 41 (Comparative) | A-144 | — | 10 | 0.89 |
| 42 " | " | PH-13 | 60 | 0.83 |
| 43 (Sample of the invention) | " | B-35 | 72 | 0.18 |
| 44 (Sample of the invention) | " | PH-13 + B-35 | 78 | 0.20 |
| 45 (Comparative) | A-150 | — | 14 | 0.82 |
| 46 " | " | PH-13 | 61 | 0.79 |
| 47 (Sample of the invention) | " | B-35 | 78 | 0.16 |
| 48 (Sample of the invention) | " | PH-13 + B-35 | 81 | 0.18 |
| 49 (Comparative) | A-168 | — | 18 | 0.80 |
| 50 " | " | PH-13 | 64 | 0.72 |
| 51 (Sample of the invention) | " | B-35 | 82 | 0.10 |
| 52 (Sample of the invention) | " | PH-13 + B-35 | 84 | 0.12 |

As is clear from Table 4, the results of the light fastness test with respect to residual dye and discoloration show that sample Nos. 41, 45, and 49, discolored and faded quite easily upon exposure to light. Sample Nos. 42, 46 and 50 used the magenta couplers of the present invention in combination with RH-13, a conventional magenta dye image stabilizer. These samples exhibited an appreciable reduction in the fading of dye image resulting from exposure to light, but their resistance to discoloration was not improved at all.

Sample Nos. 43, 47 and 51 using magenta couplers and a magenta dye image stabilizer, both in accordance with the present invention, experienced small degrees of discoloration and fading upon exposure to light.

Sample Nos. 44, 48 and 52 prepared by using the magenta coupler and magenta dye image stabilizer of the present invention in combination with a conventional magenta dye image stabilizer were improved much in light fastness of the magenta dye images as compared with Sample Nos. 43, 47 and 51.

EXAMPLE 5

A paper support laminated with polyethylene on both sides was coated with the following photographic layers in sequence from the support to obtain sample No. 53 of multi-colored silver halide photographic material.

First layer: blue-sensitive silver halide emulsion layer

This layer was formed by coating 6.8 mg/100 $cm^2$ of α-pivaloyl-α-(2,4-dioxo-1-benzylimidazolidin-3-yl)-2-chloro-5-[γ-(2,4-di-t-amylphenoxy)butylamino]acetanilide (yellow coupler), 3.2 mg/100 $cm^2$, in terms of silver, of a blue-sensitive silver chlorobromide emulsion (85 mol% silver bromide), 3.5 mg/100 $cm^2$ of dibutyl phthalate and 13.5 mg/100 $cm^2$ of gelatin.

Second layer: intermediate layer

This layer was formed by coating 0.5 mg/100 $cm^2$ of 2,5-di-t-octylhydroquinone, 0.5 mg/100 $cm^2$ of dibutyl phthalate and 9.0 mg/100 $cm^2$ of gelatin.

Third layer: green-sensitive silver halide emulsion layer

This layer was formed by coating 3.5 mg/100 $cm^2$ of magenta coupler 150 of the invention, 2.5 mg/100 $cm^2$, in terms of silver, of a blue-sensitive silver chlorobromide emulsion (80 mol% silver bromide), 3.0 mg/100 $cm^2$ of dibutyl phthalate and 12.9 mg/100 $cm^2$ of gelatin.

Fourth layer: intermediate layer

This layer was formed by coating 7.0 mg/100 $cm^2$ of 2-(2-hydroxy-3-sec-butyl-5-t-butylphenyl)benzotriazole (UV absorber), 6.0 mg/100 $cm^2$ of dibutyl phthalate, 0.5 mg/100 $cm^2$ of 2,5-di-t-octylhydroquinone and 12.0 mg/100 $cm^2$ of gelatin.

Fifth layer: red-sensitive silver halide emulsion layer

This layer was formed by coating 4.2 mg/100 $cm^2$ of 2-[α-(2,4-di-t-pentylphenoxy)butanamido]-4,6-dichloro-5-ethylphenol (cyan coupler), 3.0 mg/100 $cm^2$, in terms of silver, of red-sensitive silver chlorobromide emulsion (80 mol% silver bromide), 3.5 mg/100 $cm^2$ of tricresyl phosphate and 11.5 mg/100 $cm^2$ of gelatin.

Sixth layer: protective layer

This layer was formed by coating 8.0 mg/100 $cm^2$ of gelatin.

Sample Nos. 54 to 62 were prepared by modifying sample No. 53 with magenta dye image stabilizers of the present invention that were incorporated in the 3rd layer in the amounts indicated in Table 5. Sample Nos. 53 to 62 were processed as in Example 4 and subjected to a light-fastness test under illumination in a xenon fadeometer for 15 days. The test results are shown in Table 5.

TABLE 5

| Sample No. | Dye image stabilizer | Amount of stabilizer (mol %/coupler) | Residual magenta dye (%) |
|---|---|---|---|
| 53 (Comparative) | — | — | 25 |
| 54 (Sample of the invention) | B-6 | 50 | 58 |
| 55 (Sample of the invention) | " | 100 | 65 |
| 56 (Sample of the invention) | " | 150 | 83 |
| 57 (Sample of the invention) | B-35 | 50 | 59 |
| 58 (Sample of the invention) | " | 100 | 68 |
| 59 (Sample of the invention) | " | 150 | 85 |
| 60 (Sample of the invention) | B-46 | 50 | 54 |
| 61 (Sample of the invention) | " | 100 | 63 |
| 62 (Sample of the invention) | " | 150 | 83 |

The data in Table 5 show that the magneta dye image stabilizers in accordance with the present invention are effective in stabilizing the dye image formed by the magenta coupler of the present invention and that this effectiveness is increased as the amounts in which these stabilizers are incorporated are increased. Samples Nos. 54 to 62, as compared with sample No. 53, experienced a very small amount of discoloration in the magenta image as a result of exposure to light. Furthermore, these samples of the present invention suffered an extremely small degree of discoloration and fading in the magenta dye, and even after the light fastness test, they struck a good color balance between yellow, cyan and magenta couplers and displayed a highly satisfactory color reproduction.

EXAMPLE 6

Sample Nos. 63–75 were prepared as in Example 1 except that the combinations of magenta coupler and magenta dye image stabilizer of the present invention were used as indicated in Table 6. These samples were processed as in Example 1 and subsequently tested for their light-fastness and moisture resistance as in Example 1 except that the processed samples were placed under illumination in a xenon fadeometer for 8 days in place of 10 days. The results are shown in Table 6.

TABLE 6

| | | | Light fastness | | | Moisture resistance | |
|---|---|---|---|---|---|---|---|
| Sample No. | Coupler | Dye image stabilizer | Residual dye (%) | YS | Discoloration | Residual dye (%) | YS |
| 63 (Sample of the invention) | 209 | B-24 | 85 | 0.06 | 0.09 | 101 | 0.07 |
| 64 (Sample of the invention) | 210 | B-24 | 84 | 0.06 | 0.10 | 99 | 0.09 |
| 65 (Sample of the invention) | 211 | B-24 | 82 | 0.06 | 0.11 | 102 | 0.08 |
| 66 (Sample of the invention) | 214 | B-1 | 83 | 0.06 | 0.11 | 100 | 0.08 |
| 67 (Sample of the invention) | " | B-35 | 80 | 0.08 | 0.09 | 102 | 0.09 |
| 68 (Sample of the invention) | " | B-57 | 77 | 0.07 | 0.10 | 98 | 0.08 |
| 69 (Sample of the invention) | " | B-44 | 81 | 0.08 | 0.10 | 101 | 0.09 |

TABLE 6-continued

| Sample No. | Coupler | Dye image stabilizer | Light fastness Residual dye (%) | Light fastness YS | Light fastness Discoloration | Moisture resistance Residual dye (%) | Moisture resistance YS |
|---|---|---|---|---|---|---|---|
| 70 (Sample of the invention) | 217 | B-1 | 79 | 0.07 | 0.08 | 99 | 0.07 |
| 71 (Sample of the invention) | " | B-35 | 78 | 0.09 | 0.11 | 99 | 0.08 |
| 72 (Sample of the invention) | " | B-57 | 82 | 0.07 | 0.12 | 103 | 0.09 |
| 73 (Sample of the invention) | " | B-44 | 80 | 0.07 | 0.09 | 98 | 0.10 |
| 74 (Sample of the invention) | " | B-12 | 72 | 0.06 | 0.08 | 100 | 0.08 |
| 75 (Sample of the invention) | " | B-56 | 74 | 0.06 | 0.08 | 100 | 0.09 |

What is claimed is:

1. A silver halide color photographic material containing a magenta color image-forming coupler represented by the following formula (I) and a compound represented by the following formula (XI):

(I)

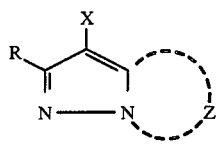

wherein

Z represents the group of nonmetallic atoms necessary for forming a nitrogen-containing heterocyclic ring, provided that the ring to be formed by said Z may have a substituent;

X represents a hydrogen atom or a substituent capable of leaving upon reaction with the oxidized product of a color developing agent; and R represents a hydrogen atom or a substituent.

(XI)

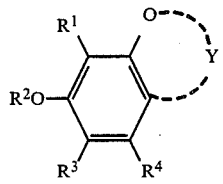

wherein $R^1$ and $R^4$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamido group, a cycloalkyl group or an alkoxycarbonyl group;

$R^2$ represents a hydrogen atom, an alkyl group, an alkenyl group, an aryl group, an acyl group, a cycloalkyl group or a heterocyclic group;

$R^3$ represents a hydrogen atom, a halogen atom, an alkyl group, an alkenyl group, an aryl group, an aryloxy group, an acyl group, an acylamino group, an acyloxy group, a sulfonamide group, a cycloalkyl group or an alkoxycarbonyl group;

$R^2$ and $R^3$ may cooperate to form a 5- or 6-membered ring; and

Y represents the group of atoms necessary to form a chroman or cumaran ring.

2. A silver halide color photographic material according to claim 1, wherein said magenta color image-forming coupler is one represented by any of the following formulas (II), (III), (IV), (V), (VI) and (VII):

(II)

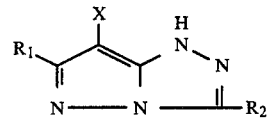

(III)

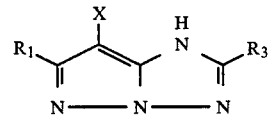

(IV)

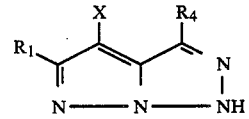

(V)

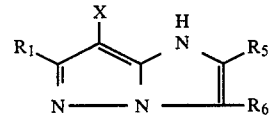

(VI)

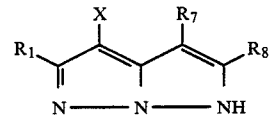

(VII)

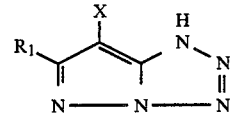

wherein $R_1$ to $R_8$ each represents a hydrogen atom or a substituent; and

X represents a hydrogen atom or a substituent capable of leaving upon reaction with the oxidized product of a color developing agent.

3. A silver halide color photographic material according to claim 1, wherein said magenta color image-forming coupler is one having a group represented by the following formula:

$$-R^a-SO_2-R^b$$

wherein $R^a$ represents an alkylene group having 3 or more carbon atoms in the straight chain that is bonded to the hydrocarbon at 3-position of the coupler; and $R^b$ represents an alkyl group, a cycloalkyl group or an aryl group.

4. A silver halide color photographic material according to claim 1, wherein R in said formula (I) represents a halogen atom, an alkyl group, an aryl group, a heterocyclic group or an alkylthio group.

5. A silver halide color photographic material according to claim 2, wherein $R_1$ in said formulas (II) to (VII) represents a halogen atom, an alkyl group, an aryl group, a heterocyclic group or an alkylthio group.

6. A silver halide color photographic material according to claim 2, wherein R in said formula (I) and $R_1$ in said formulas (II) to (VII) each is represented by the following formula:

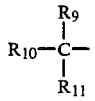

wherein two of $R_9$ to $R_{11}$ are alkyl groups and the other one is a hydrogen atom or an alkyl group.

7. A silver halide color photographic material according to claim 2, wherein said magenta color image-forming coupler is one represented by formula (II).

8. A silver halide color photographic material according to claim 7, wherein $R_2$ of formula (II) is represented by the following formula:

$$-R^a-SO_2-R^b$$

wherein $R^a$ and $R^b$ are the same in meaning as $R^a$ and $R^b$ in claim 3.

9. A silver halide color photographic material according to claim 1, wherein the compound represented by said formula (XI) is one selected from among those compounds represented by the following formulas (XII) to (XVI):

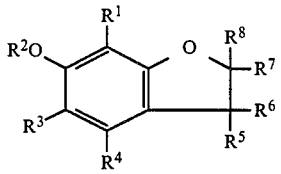

(XII)

-continued

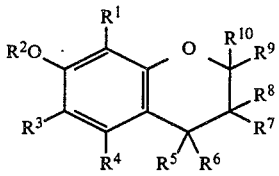

(XIII)

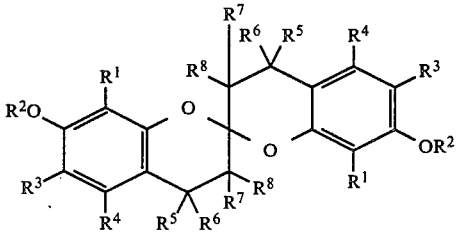

(XIV)

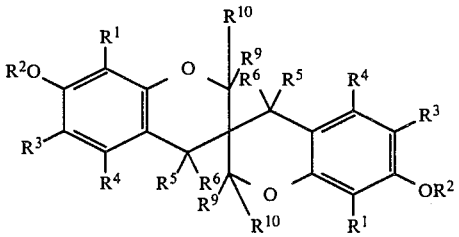

(XV)

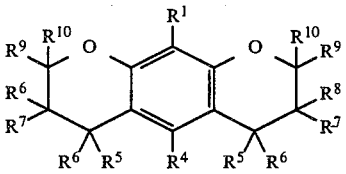

(XVI)

wherein $R^1$, $R^2$, $R^3$ and $R^4$ are the same in meaning as $R^1$, $R^2$, $R^3$ and $R^4$ in formula (XI); and $R^5$, $R^6$, $R^7$, $R^8$, $R^9$ and $R^{10}$ each represents a hydrogen atom, a halogen atom, an alkyl group, an alkoxy group, a hydroxy group, an alkenyl group, an alkenyloxy group, an aryl group, an aryloxy group or a heterocyclic group;

$R^5$ and $R^6$, $R^6$ and $R^7$, $R^7$ and $R^8$, $R^8$ and $R^9$, $R^9$ and $R^{10}$ each may cooperate to form a carbon ring, which ring may be substituted by an alkyl group.

10. A silver halide color photographic material according to claim 2, wherein said magenta color image forming coupler is represented by Formula II.

* * * * *